United States Patent [19]

Ushioda et al.

[11] Patent Number: 4,807,790

[45] Date of Patent: Feb. 28, 1989

[54] PAPER FEEDING METHOD AND APPARATUS

[76] Inventors: Kentaro Ushioda, 15-13, Sakuragaoka 2-chome, Setagaya-ku, Tokyo; Shigeaki Yamaguchi, 22-9, Masugata 6-chome, Tama-ku, Kawasaki-shi, Kanagawa-ken, both of Japan

[21] Appl. No.: 917,776

[22] Filed: Oct. 10, 1986

[51] Int. Cl.[4] ..... B65H 23/00; G03G 15/10

[52] U.S. Cl. ..... 226/2; 226/45; 226/168; 271/266

[58] Field of Search ..... 226/24, 45, 168, 1, 226/2, 27; 271/265, 266

[56] References Cited

U.S. PATENT DOCUMENTS

| | | | |
|---|---|---|---|
| 3,497,121 | 2/1970 | Gold et al. | 226/2 |
| 3,656,673 | 4/1972 | Erikson | 226/2 |
| 3,713,571 | 1/1973 | Simonton | 226/2 |
| 4,143,566 | 3/1979 | Luciak et al. | 226/2 X |
| 4,485,949 | 12/1984 | Gebhart et al. | 226/2 |

*Primary Examiner*—Stuart S. Levy
*Assistant Examiner*—Lynn M. Sohacki

[57] ABSTRACT

To feed a sheet of paper by use of a frictional force with the paper sheet, feed holes aligned in the direction of feeding at either edge of the paper sheet are detected by means of a feed hole detecting means located in a feed hole detecting position. An actual amount of paper feeding is measured by detecting the feed holes that pass through the feed hole detecting position, and then the amount by which the paper feeding means is to advance is adjusted according to the measured actual amount of paper feeding. Paper feeding can thereby be precisely controlled. Additionally, a paper feeding amount control circuit measures the initial phase difference between the position of a feed hole in a sheet of paper and the feed hole detecting position in the initial stage of paper feeding. It counts the number of feed holes passing through the feed hole detecting position during paper feeding and then feeds the papers by a further amount corresponding to the measured initial phase difference after the counted number of feed holes become equal to that corresponding to one page of the paper sheet. One-page paper feeding is thereby performed with accuracy.

6 Claims, 17 Drawing Sheets

FIG. 5

| TOTAL NUMBER OF FEEDING PULSES | DETECTING POINT OF FEED HOLE START POSITION | NUMBER OF PULSES BETWEEN FEED HOLE START POSITIONS | NUMBER OF EXCESSIVE OR DEFICIENT PULSES BETWEEN FEED HOLE START POSITIONS | CUMULATIVE NUMBER OF EXCESSIVE AND DEFICIENT PULSES | LINE | NUMBER OF INSTRUCTION PULSES IN NEW-LINE OPERATION | BOUNDARY POSITION OF PAGES |
|---|---|---|---|---|---|---|---|
| 0 | | | | | | | |
| 10 | X1 | | | | 1 | 20 | |
| | | 60 | 0 | | 2 | 20 | |
| | | | | | 3 | 20 | |
| 70 | X2 | | | | 4 | 20 | |
| | | 59 | +1 | 0 | 5 | 20 | |
| | | | | | 6 | 20 | |
| 129 | X3 | | | | 7 | 20 | |
| | | 60 | 0 | +1 | 8 | 20 | |
| | | | | | 9 | 20 | |
| 189 | X4 | | | | 10 | 20 | |
| | | 59 | +1 | +1 | 11 | 20 | |
| | | | | | 12 | 20 | |
| 248 | X5 | | | | 13 | 19 | |
| | | | | +2 | 14 | 20 | |
| | | 60 | 0 | +1 | 15 | 20 | |
| 308 | X6 | | | | 16 | 20 | |
| | | 59 | +1 | +1 | 17 | 20 | |
| | | | | | 18 | 20 | |
| 367 | X7 | | | | 19 | 19 | |
| | | | | +2 | 20 | 20 | |
| | | 59 | +1 | +1 | 21 | 20 | |
| 426 | X8 | | | | 22 | 19 | |
| | | | | +2 | | | |
| 1199 | X21 | | | | 61 | 20 | |
| | | 59 | +1 | +1 | 62 | 20 | |
| | | | | | 63 | 20 | |
| 1258 | X22 | | | | 64 | 19 | |
| | | | | +2 | 65 | 20 | |
| | | 60 | 0 | +1 | 66 | 20 | |
| 1307 | | | | | | | |
| 1318 | X23 | | | | 67 | 20 | |
| | | 60 | 0 | +1 | 68 | 20 | |
| | | | | | 69 | 20 | |
| 1378 | X24 | | | | 70 | 20 | |

FIG. 7

| TOTAL NUMBER OF FEEDING PULSES | DETECTING POINT OF FEED HOLE START POSITION | NUMBER OF PULSES BETWEEN FEED HOLE START POSITIONS | NUMBER OF EXCESSIVE OR DEFICIENT PULSES BETWEEN FEED HOLE START POSITIONS | CUMULATIVE NUMBER OF EXCESSIVE AND DEFICIENT PULSES | LINE | NUMBER OF INSTRUCTION PULSES IN NEW-LINE OPERATION | BOUNDARY POSITION OF PAGES |
|---|---|---|---|---|---|---|---|
| 0 | | | | | | | |
| 10 | X1 | | | | 1 | 20 | |
| | | 60 | 0 | | 2 | 20 | |
| | | | | | 3 | 20 | |
| 70 | X2 | | | | 4 | 20 | |
| | | 61 | -1 | | 5 | 20 | |
| | | | | | 6 | 20 | |
| 131 | X3 | | | | 7 | 20 | |
| | | 61 | -1 | -1 | 8 | 20 | |
| | | | | | 9 | 20 | |
| 192 | X4 | | | -2 | 10 | 21 | |
| | | 60 | 0 | -1 | 11 | 20 | |
| | | | | | 12 | 20 | |
| 252 | X5 | | | | 13 | 20 | |
| | | 61 | -1 | -1 | 14 | 20 | |
| | | | | | 15 | 20 | |
| 313 | X6 | | | -2 | 16 | 21 | |
| | | 60 | 0 | -1 | 17 | 20 | |
| | | | | | 18 | 20 | |
| 373 | X7 | | | | 19 | 20 | |
| | | 61 | -1 | -1 | 20 | 20 | |
| | | | | | 21 | 20 | |
| 434 | X8 | | | | 22 | 20 | |
| 1222 | X21 | | | -2 | 61 | 21 | |
| | | 60 | 0 | -1 | 62 | 20 | |
| | | | | | 63 | 20 | |
| 1282 | X22 | | | | 64 | 20 | |
| | | 61 | -1 | -1 | 65 | 20 | |
| | | | | | 66 | 20 | |
| 1333 | | | | | | | |
| 1343 | X23 | | | -2 | 67 | 21 | |
| | | 60 | | -1 | 68 | 20 | |
| | | | | | 69 | 20 | |
| 1403 | X24 | | | | 70 | 20 | |

FIG. 9

| TOTAL NUMBER OF FEEDING PULSES | DETECTING POINT OF FEED HOLE START POSITION | NUMBER OF PULSES BETWEEN FEED HOLE START POSITIONS | NUMBER OF EXCESSIVE OR DEFICIENT PULSES BETWEEN FEED HOLE START POSITIONS | CUMULATIVE NUMBER OF EXCESSIVE AND DEFICIENT PULSES | LINE | NUMBER OF INSTRUCTION PULSES IN NEW-LINE OPERATION | BOUNDARY POSITION OF PAGES |
|---|---|---|---|---|---|---|---|
| 0 | | | | | | | |
| 10 | X1 | 60 | 0 | | 1 | 20 | |
| | | | | | 2 | 20 | |
| | | | | | 3 | 20 | |
| 70 | X2 | 59 | +1 | 0 | 4 | 20 | |
| | | | | | 5 | 20 | |
| | | | | | 6 | 20 | |
| 129 | X3 | 60 | 0 | +1 | 7 | 20 | |
| | | | | | 8 | 20 | |
| | | | | | 9 | 20 | |
| 189 | X4 | 61 | -1 | +1 | 10 | 20 | |
| | | | | | 11 | 20 | |
| | | | | | 12 | 20 | |
| 250 | X5 | 61 | -1 | 0 | 13 | 20 | |
| | | | | | 14 | 20 | |
| | | | | | 15 | 20 | |
| 311 | X6 | 61 | -1 | -1 | 16 | 20 | |
| | | | | | 17 | 20 | |
| | | | | | 18 | 20 | |
| 372 | X7 | 60 | 0 | -2 | 19 | 21 | |
| | | | | -1 | 20 | 20 | |
| | | | | | 21 | 20 | |
| 432 | X8 | | | | 22 | 20 | |
| 1218 | X21 | 59 | +1 | +1 | 61 | 20 | |
| | | | | | 62 | 20 | |
| | | | | | 63 | 20 | |
| 1277 | X22 | 60 | 0 | +2 | 64 | 19 | |
| | | | | +1 | 65 | 20 | |
| | | | | | 66 | 20 | |
| 1327 | | | | | | | |
| 1337 | X23 | 61 | -1 | +1 | 67 | 20 | |
| | | | | | 68 | 20 | |
| | | | | | 69 | 20 | |
| 1398 | X24 | | | | 70 | 20 | |

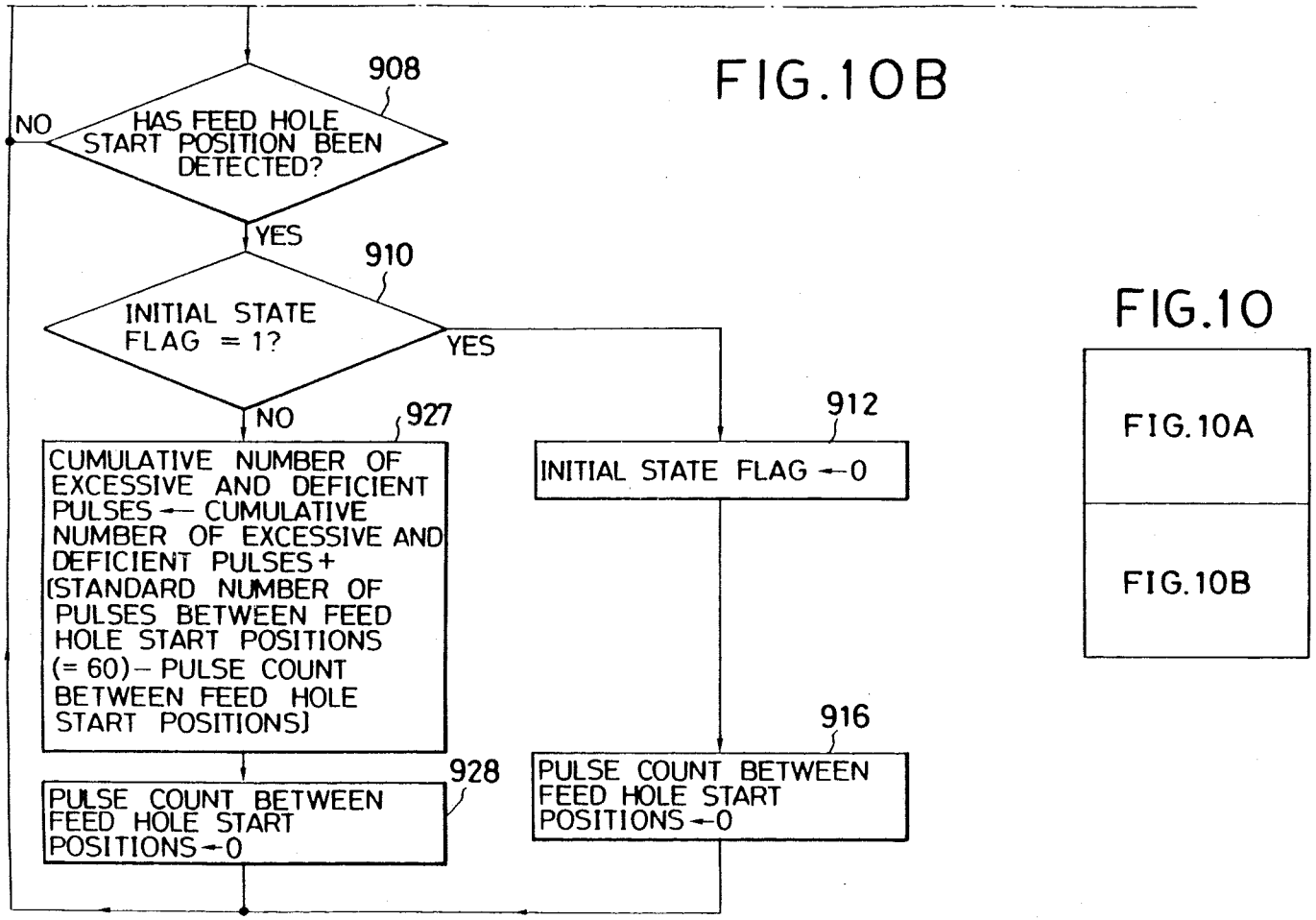
FIG.10
FIG.10A
FIG.10B
FIG.10B
908
HAS FEED HOLE START POSITION BEEN DETECTED?
NO
YES
910
INITIAL STATE FLAG = 1?
YES
NO
912
INITIAL STATE FLAG ← 0
927
CUMULATIVE NUMBER OF EXCESSIVE AND DEFICIENT PULSES ← CUMULATIVE NUMBER OF EXCESSIVE AND DEFICIENT PULSES + (STANDARD NUMBER OF PULSES BETWEEN FEED HOLE START POSITIONS (= 60) − PULSE COUNT BETWEEN FEED HOLE START POSITIONS)
916
PULSE COUNT BETWEEN FEED HOLE START POSITIONS ← 0
928
PULSE COUNT BETWEEN FEED HOLE START POSITIONS ← 0

| FIG.11A | FIG.11B |
|---|---|

FIG. 18
PRIOR ART
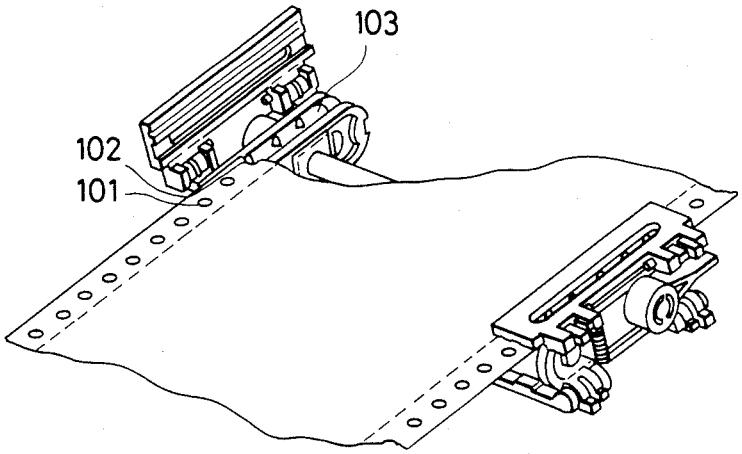
FIG. 19B
PRIOR ART
FIG. 19A
PRIOR ART
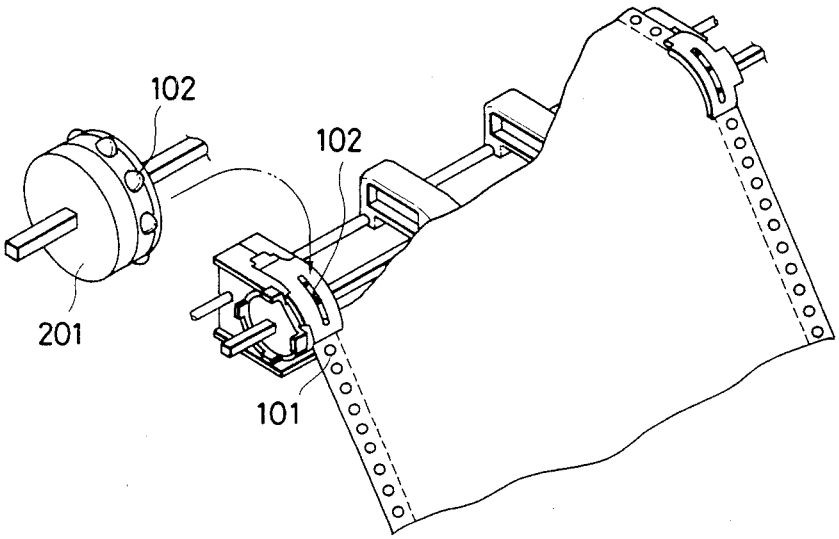

PAPER FEEDING METHOD AND APPARATUS

BACKGROUND OF THE INVENTION

1. Field of the Invention

The present invention relates to a paper feeding method and apparatus, and more particularly to a method and apparatus for performing the feeding of a sheet of paper.

2. Description of the Prior Art

A paper feeding mechanism in a printer or the like is so designed that paper is fed by the length of predetermined minimum unit in correspondence with the one-step movement of a driving source such as pulse motor. Accordingly, in a case where the paper is to be fed by a certain length, the pulse motor or the like which is the driving source for paper feeding may be moved by the number of steps corresponding to the length.

However, the actual amount of feeding involves a relative error (it is slight, usually, 0.3–1%) on account of the slippage of the paper, caused by variation in friction, the expansion or contraction of the paper, the elastic deformation of a platen or roller made of rubber, etc.

For this reason, in a case where a large number of pages are to be printed in succession by using paper in which pages are continuous in the direction of paper feeding, such as fan-fold paper (paper called 'continuous slip' in Japanese Industrial Standard JIS C6283), which is extensively used as paper for printers, the feeding errors are accumulated to gradually shift a printing position. Eventually, printing to be contained within a single page extends over two successive pages.

Moreover, in case of printing on sheets of paper each of which is printed with a prescribed form beforehand, the printing can protrude out of the form.

In order to prevent such drawbacks, mechanisms called 'tractors' as shown in FIG. 18 and FIGS. 19A and 19B have heretofore been employed. These mechanisms are intended to maintain accurate paper feeding by bringing the protuberances (pins) 102 of the tractors into the feed holes 101 of sheets of paper. The mechanism of FIG. 18 uses belts 103 (tractor belts) having the protuberances, while the mechanism of FIGS. 19A and 19B uses cylinders (called 'sprocket wheels') having the protuberances 102 as indicated at numeral 201.

For fan-fold paper, the dimensions of the sheet of paper, the positions of the holes, etc. are stipulated by Japanese Industrial Standard (JIS) C6283 in order to ensure interchangeability.

There are many varieties of such tractors; they vary in shape and in the location in which they are installed, and some are permanently built in to printers, while others are removable.

Next, typical tractors will be briefly explained.

In the first place, the kinds of the typical tractors will be elucidated with reference to FIGS. 20 thru 23.

Throughout these figures, numeral 303 designates a sheet of paper, numeral 304 a platen, numeral 305 a direction of paper feeding, and numeral 306 a printing position.

In FIG. 20, the sheet of paper 303 enters a tractor 302 after passing through the printing position 306. The tractor 302 functions to draw up the sheet of paper 303. It is called a "front tractor".

In FIG. 21, the sheet of paper 303 enters a tractor 401 before passing through the printing position 306. The tractor 401 functions to push out the paper 303. It is called a "back tractor". Many of such tractors are built in printers by the use of sprocket wheels.

A tractor in FIG. 22 is called a "double-faced tractor". It utilizes both the front and rear surfaces of a tractor belt 501, and performs paper feeding drive at both positions preceding and succeeding the printing position 306.

A tractor in FIG. 23 is such that pins (sprocket pins) for feed hole drive are provided at both the edges of the platen 304. It is called a "pin feed platen".

Secondly, the problems of the respective tractors will be stated.

Useless Feeding of Paper

With the system of FIG. 20 or FIG. 22, in order to take out printed pages after the end of printing, a lateral perforated line (a perforated line for severance horizontally formed at the boundary of pages) between the last printed page and the next page must advance out of the tractor, and hence, the paper 303 must be uselessly fed in an amount of one page. When this occurs, not only is the paper 303 wasted, but time is also wasted, particularly when the printer is a slow one.

Price of Tractor

The price of a tractor varies depending upon the speed, reliability, etc. thereof. The tractors of the systems in FIG. 20, FIG. 21 and FIG. 22 account for approximately 5% to 15% of the price of inexpensive printers. The tractor in FIG. 22 is particularly expensive because of the complicated mechanism.

Laboriousness in Setting Paper

It is quite cumbersome to set the paper on the tractor of the system in FIG. 20, FIG. 21 or FIG. 22. Moreover, unless the paper 303 is exactly set, trouble in the paper feeding is caused, so that the setting operation requires attentiveness and is laborious. Particularly, the setting of the paper on the tractor in FIG. 22 is particularly cumbersome.

INCREASE IN SIZE OF APPARATUS

The tractor of the system in FIG. 20 or FIG. 22 is disposed over the apparatus and has no influence on the area that the apparatus occupies, but it increases a required height. In a case where the tractor in FIG. 21 is built in the apparatus, it occupies a considerable part of the apparatus and enlarges this apparatus.

NOISE

Since the tractor in FIG. 20, FIG. 21 or FIG. 22 has a power transmission mechanism such as a belt or gears, noise develops. Further, in the case of the tractor in FIG. 20 or FIG. 22, the tractor itself is apt to vibrate over the apparatus and the paper is spread into a stretched form, so that the paper at this part acts as a vibrating diaphragm and amplifies the noise still more.

INCREASE IN PAPER FEEDING TORQUE

Since the tractor in FIG. 20, FIG. 21 or FIG. 22 has a considerable inertia in the moving parts, a great driving torque is required, with the attendant high supply voltage, power consumption, noise etc. This is particularly true in the case of the tractor of FIG. 22.

TROUBLE IN PAPER FEEDING

The tractor in FIG. 20 is liable to bring about trouble in the mode of paper feeding in the reverse direction, and is usually limited in the length by which the paper can be reversely fed. On the other hand, the tractor in FIG. 21 is prone to trouble in paper feeding in the forward direction, and some types of paper reduce its reliability, as do certain regimes of temperature, humidity, and other environmental conditions.

In addition, the tractor in FIG. 20 or FIG. 22 has a low strength against torsion, and the torsion can form the cause of the trouble of paper feeding.

ACCESSORY HANDLING

The tractor in FIG. 20 or FIG. 22 comes as a separately sold (optional) accessory. In this case, the number of accessories increases by one, and the production schedule, the stock control, etc. become cumbersome to that extent.

ADJUSTMENT OF PAPER WIDTH

The tractor of the system in FIG. 23 is free from the disadvantages mentioned above. Disadvantageously, however, it is incapable of adjusting the width of the sheet of paper and therefore can only be used with a single paper width.

In short, all of these tractors have their respective disadvantages.

SUMMARY OF THE INVENTION

An object of the present invention is to provide a paper feeding method and apparatus which precisely feed a sheet of paper frictionally without positively engaging feed holes formed at an edge or edges of the paper sheet.

The paper feeding method according to the present invention comprises the step of feeding a sheet of paper by paper feeding means owing to friction thereof with the paper sheet, the step of employing feed-hole detection means at a feed-hole detection position to detect feed holes formed in at least either edge of the paper sheet and aligned in a direction of the feeding, and the step of adjusting a mechanism advancement distance to be thereafter given as an instruction to said paper feeding means, in accordance with an actual amount of paper feeding found by detecting the feed holes passing through the feed hole detecting position during the paper feeding, so as to precisely control the actual amount of paper feeding, whereby the paper feeding free from an accumulated error is performed without employing a mechanism which positively engages the feed holes.

The paper feeding apparatus according to the present invention comprises paper feeding means for frictionally feeding a sheet of paper, feed hole detection means for detecting at a feed hole detection position feed holes formed in at least either edge of the paper sheet and aligned in a direction of the feeding, and a feed-control circuit which adjusts a mechanism-advancement distance to be thereafter given as an instruction to said paper feeding means (e.g., adjusts the number of pulses applied to a stepper motor to advance a platen by one print line), in accordance with an actual amount of paper feeding found by detecting the feed holes passing through the feed hole detecting position during the paper feeding; said feed-control circuit adjusting the desired amount of paper feeding to be thereafter given as the instruction to said paper feeding means, in accordance with an error between the actual amount of paper feeding found by detecting the feed holes passing through the feed hole detecting position during the paper feeding and a mechanism-advancement distance given as an instruction to said paper feeding means, so as to precisely control the actual amount of paper feeding, whereby the paper feeding free from an accumulated error is performed without employing a mechanism which positively engages the feed holes.

Further, the paper feeding apparatus according to the present invention comprises paper feeding means for frictionally feeding a sheet of paper, feed hole detection means for detecting, at a feed-hole detection position, feed holes formed in at least either edge of the paper sheet and aligned in a direction of the feeding, and a feed-control circuit which adjusts a mechanism-advancement distance to be thereafter given as an instruction to said paper feeding means, in accordance with an actual amount of paper feeding found by detecting the feed holes passing through the feed hole detecting position during the paper feeding; said paper feeding amount control circuit measuring an initial phase difference between a feed hole position of the sheet of paper and the feed hole detecting position under an initial state of the paper feeding, counting a number of the feed holes passing through the feed hole detecting position for one page of the paper sheet, and feeding the paper by a further length corresponding to the initial phase difference after the counted number of the feed holes has corresponded to one page of the paper sheet, so as to precisely effect the paper feeding of the length for one page of the paper sheet and to precisely control the amount of paper fed, whereby the paper feeding free from an accumulated error is performed without employing a mechanism which mechanically drives the feed holes.

According to the present invention, the problems involved in the prior-art mechanical tractors can be solved, and the amount of paper feeding of a sheet of paper can be precisely controlled in such a way that the sheet of paper is frictionally fed without positively engaging driving feed holes formed at an edge or edges of the paper sheet. Accordingly, the amount of paper actually fed is precisely controlled, and paper feeding free from an accumulated error can be performed without employing a mechanism which positively engages the feed holes. Incidentally, the control of the paper feeding can be readily effected with, e.g., a microprocessor used in an apparatus such as printer, and a sensor for the feed hole detection and the peripheral circuits thereof are very low in price and simple in structure.

The above and other objects and features of the present invention will become apparent from the following description of the preferred embodiments taking reference to the accompanying drawings.

BRIEF DESCRIPTION OF THE DRAWINGS

FIG. 5 is a table showing a process for correcting the paper feeding error;

FIG. 7 is a table showing a process for correcting the paper feeding error;

FIG. 9 is a table showing a process for correcting the paper feeding error;

FIGS. 10A and 10B, when connected as shown in FIG. 10, show a flow chart showing a paper feeding control according to the first embodiment of the present invention;

FIG. 18 is a perspective view showing a prior-art tractor;

FIGS. 19A and 19B are outward perspective views showing another prior-art tractor.

DESCRIPTION OF THE PREFERRED EMBODIMENTS

First Embodiment

Figure 1:
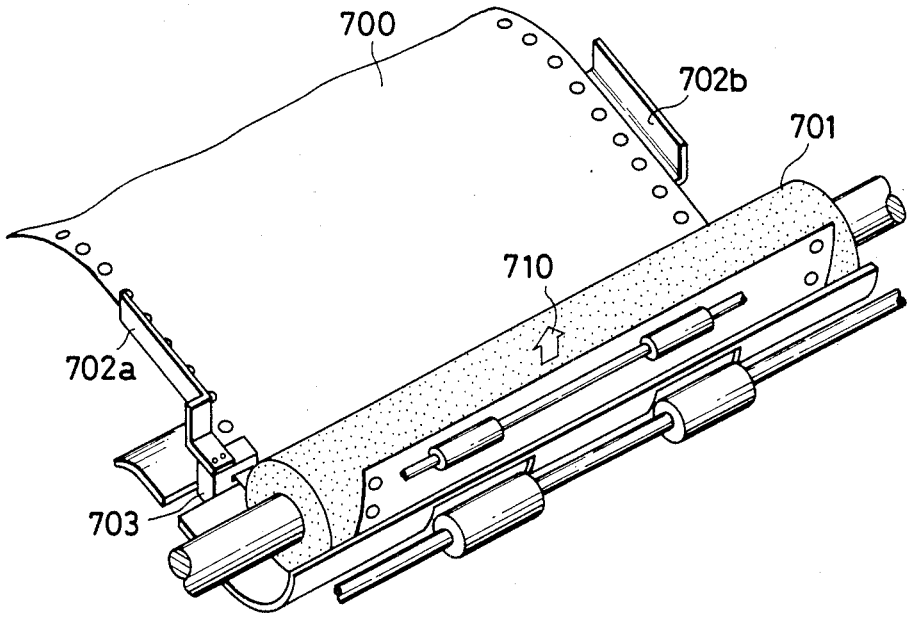
FIG. 1 is perspective view of a paper feeding apparatus according to the first embodiment of the present invention.
Figure 2:
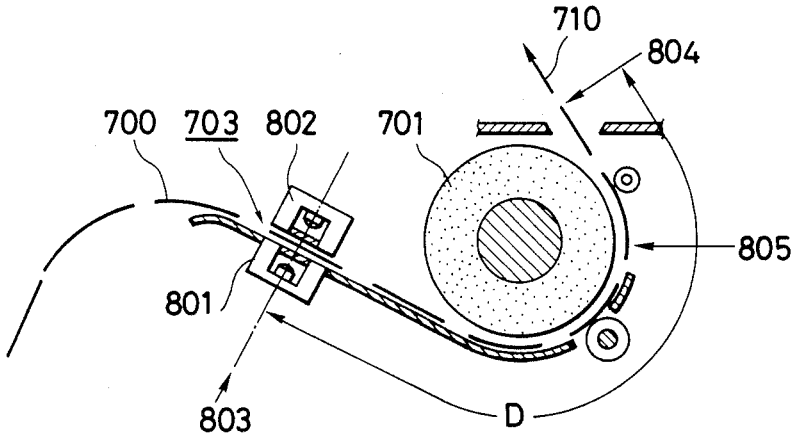
FIG. 2 is a sectional view of the apparatus in FIG. 1.
Figures 3A, 3B, 3C, 3D, 3E:
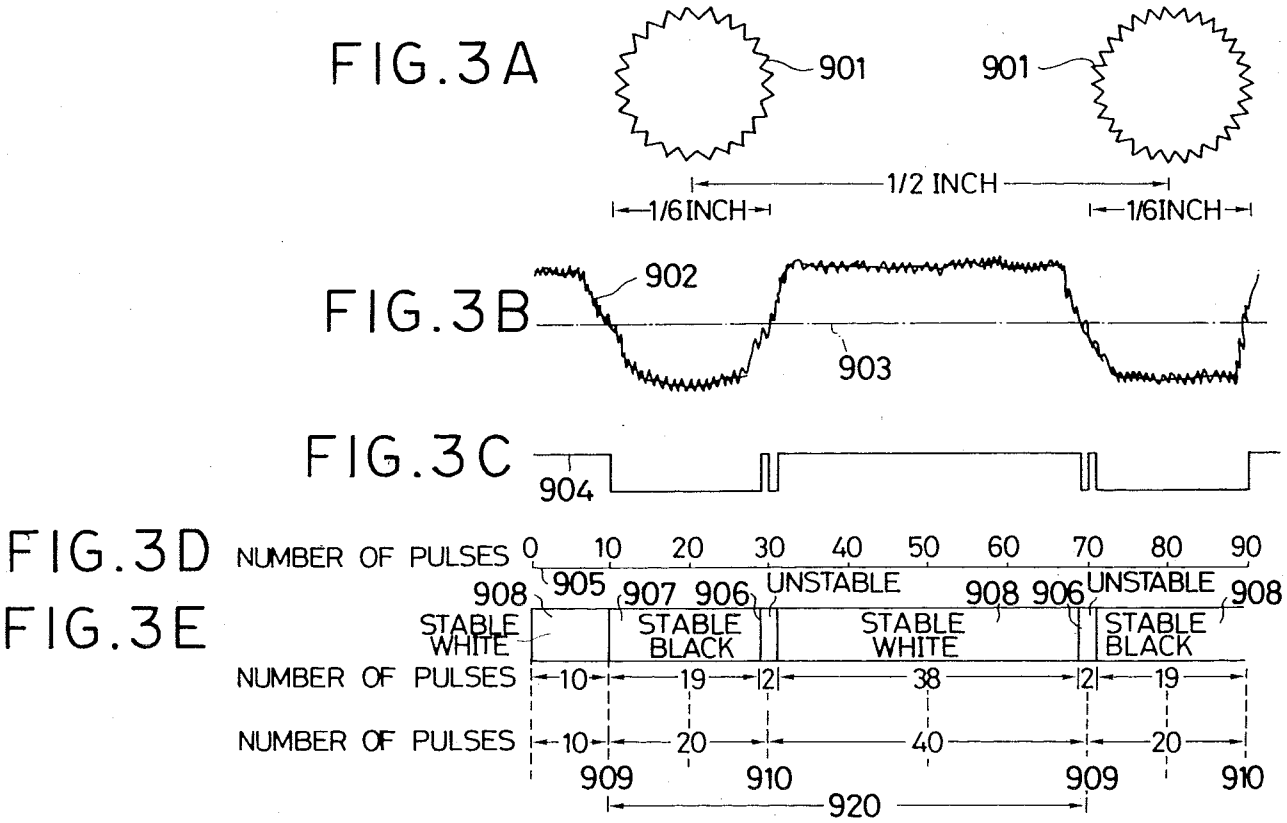
FIG. 3A is a diagram showing feed holes.
FIG. 3B is a waveform diagram of a detection signal.
FIG. 3C is a waveform diagram of a signal obtained by binary-coding the detection signal.
FIG. 3D is a diagram showing the number of paper feeding drive pulses.
FIG. 3E is a state diagram of the binary-coded signal.

FIGS. 1 and 2 show a paper feeding apparatus according to the first embodiment of the present invention.

In FIG. 1, numeral 701 designates a platen. Symbols 702*a* and 702*b* denote paper sheet guides which can be slid rightwards and leftwards, and whose positions are set in conformity with the width of a sheet of paper, thereby to prevent the sheet of paper 700 from inclining or laterally shifting during paper feeding. One 702*a* of the paper sheet guides is furnished with a transmission type optical sensor 703, and when the paper sheet guide 702*a* has been set to the edge of the paper sheet 700, the transmission type optical sensor 703 comes just to a position through which feed holes pass. The transmission type optical sensor 703 includes a light emitting diode and a photodiode, and can detect at an accuracy of approximately 0.3 mm, whether or not an opaque object interceptive of light exists between the two diodes.

Accordingly, th sensor 703 can precisely detect the feed holes which pass between the light emitting diode and the photodiode.

FIG. 2 is a sectional view in which the paper feeding system in FIG. 1 is cut along a plane containing the center line of the feed holes on the side of the guide 702*a*. Numeral 802 indicates the light receiving side portion of the transmission type optical sensor, numeral 801 the light emitting side portion thereof, and numeral 803 the feed hole detecting position. In the initial state of the apparatus (a state before a series of operations such as paper feeding and printing are started), the lateral perforated line of the paper sheet 700 is assumed to lie at a position 804. This position shall be termed the "initial lateral perforation position 804." A length D is the length of the traveling path of the paper sheet between the feed hole detecting position 803 and the initial lateral perforation position 804. Numeral 805 indicates a printing position.

Next, FIGS. 3A, 3B, 3C, 3D and 3E show the feed holes, a detection signal, the binary-coded signal of the detection signal, the number of paper feeding drive pulses (1 step = 1/120 inch) and the state diagram of the binary-coded signal, respectively.

In FIGS. 3A–3E, numeral 901 designates the feed hole, the diameter of which is about 1/6 inch ordinarily. Numeral 902 indicates the output signal from the transmission type optical sensor, numeral 904 the signal binary-coded with a threshold level 903 for deciding the presence or absence of the feed hole, and numeral 905 the number of driving pulses applied to a paper feeding pulse motor.

Numeral 906 indicates a part where the decision of the presence or absence of the feed hole is unstable due to the peripheral roughness of the feed hole, the noise of the signal from the sensor, and so forth, numeral 907 a part where the presence of the feed hole is being stably detected, and numeral 908 a part where the absence of the feed hole is being stably detected.

The start position 909 (FIG. 3E) is set in the middle of the unstable interval of the transition from the level indicating feed-hole absence to the level indicating feed-hole presence. Similarly, the end feed-hole position (FIG. 3E) is set in the middle of the unstable interval in the transition from the level indicating feed-hole presence to the level indicating feed-hole absence.

A section 920 from the feed hole start position 909 to the next feed hole start position 909 shall be termed the "section of the feed hole start positions."

This example is so designed that the sheet of paper is fed by about 1/120 inch every driving pulse. The amount of paper fed per driving pulse is sufficiently small as compared with the diameter of the feed hole (in this example, the diameter of the feed hole is substantially equivalent to 20 pulses), so that the position of the feed hole can be precisely detected.

Since the feed holes are formed at pitches of ½ inch, the section of the feed hole start positions is ½ inch long, and the number of driving pulses corresponding thereto is:

$$\tfrac{1}{2}\ \text{(inch/line)} \div 1/20\ \text{(inch/pulse)} = 60\ \text{(pulses/line)}$$

Two aspects of the present invention will now be described in connection with respective first and second embodiments of the invention for controlling a system of the foregoing type. The first aspect, illustrated by the first embodiment, is an arrangement for insuring the proper spacing between print lines even though the paper is being fed by friction rather than by positive engagement of the holes and may therefore slip with respect to the platen 701. As was just described, a predetermined number of pulses is nominally required to reach a feed hole, and a predetermined number of pulses is nominally required to space print lines properly. In accordance with the first embodiment, if a feed hole is detected before or after the feed mechanism has advanced by the amount that should nominally be required to reach that feed hole, the advancement between print lines is adjusted so that the actual mechanism advancement required to reach a print line differs from a nominal amount in accordance with the difference between the actual and nominal distances required to reach the last feed hole. The result is that the print lines maintain the right positions on the page despite any slippage that may occur between the paper and the feed mechanism.

PAPER FEEDING AMOUNT CONTROL ACCORDING TO FIRST EMBODIMENT

Next, a method of precisely controlling the amount of paper feeding with these signals will be described with reference to FIGS. 4A, 4B, FIG. 5, FIGS. 6A and 6B, FIG. 7, FIG. 8 and FIG. 9.

The first embodiment is characterized in that, during paper feeding, subsequent paper-feed instructions are adjusted according to the error between the actual amount of paper feeding found by detecting the feed holes passing through the feed hole detecting position and the mechanism-advancement distance already given as an instruction to paper feeding means.

Figure 4A:
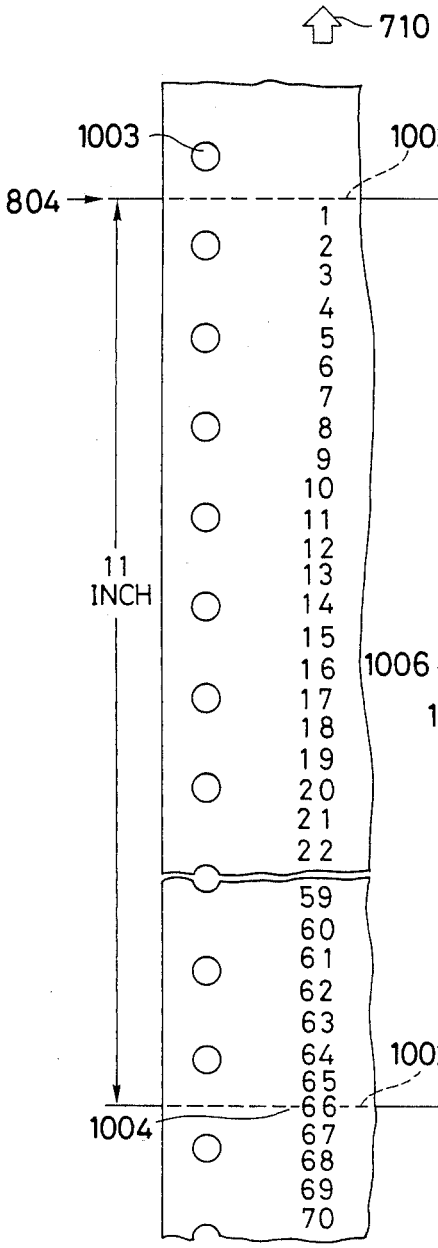
FIG. 4A is a diagram showing the state in which a sheet of paper has been fed 1% too far.
Figure 4B:
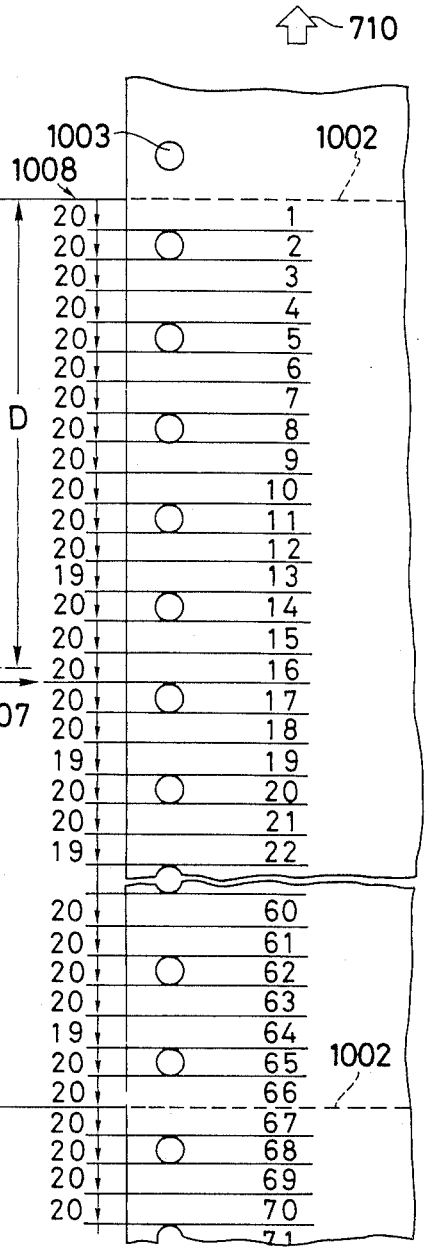
FIG. 4B is a diagram showing the state in which a paper feeding error has been corrected.

FIGS. 4A and 4B show an example wherein numerals 1, 2, 3, 4, etc. are printed on the respective lines of a sheet of paper, one page of which is 11 inches long, successively from the upper end thereof at a rate of 6 lines/inch.

In FIG. 4A or 4B, an arrow 710 indicates the direction of paper feeding, numeral 1002 a lateral perforated line, numeral 1003 the feed hole, and numeral 804 the initial lateral perforation position.

Shown at numeral 1006 is the feed hole detecting position, which the feed hole detecting sensor monitors when the apparatus is in the initial state. The feed hold detecting position is spaced from the initial lateral perforation position 804 by the length D as illustrated in FIG. 2.

In a case the length of the paper sheet is accurate and where the paper feeding apparatus feeds the paper at precisely 1/120 inch per pulse, the printing of the 66th line ought to come exactly to the lower end of the page because the length of 1 page is 11 inches. In actuality, however, an error in the feeding length develops due to the relative deviation between the error of the paper feeding apparatus side and the error of the length of the paper sheet ifself. By way of example, if the length of the paper sheet is 1% less than nominal but the distance through which the paper has been fed is, too the relative error is 0% and the printing position does not misregister. In contrast, if the distance through which the paper has been fed is 0.4% greater than the nominal distance and the paper sheet is 0.6% shorter than that distance, the paper sheet is fed by 1% more than it should be. That is, the actual printing position on the paper sheets shifts down by 1%. In the ensuing description, it shall be assumed for better understanding that the length of the paper sheet is accurate.

Since the spacing is ½ inch between the feed hole start positions, 60 pulses should theoretically be the correct number of pulses to achieve the desired feed distance. If the feed distance per pulse is actually greater than the nominal 1/120 of an inch, however, fewer pulses will be needed to drive the paper from one hole position to the next.

By way of example, in a case where the feeding error is +1%, the sheet of paper is fed 1.01 inch by 120 pulses and paper feeding of 1 inch is effected by:

$$120/1.01 = 118.81 \text{ pulses}$$

Since 1 inch equals twice the distance between successive feed hole start positions, the number of pulses between the feed hole start positions should alternate between 59 and 60, the two numbers occurring with nearly equal frequency.

To the contrary, in a case where the feeding error is −1%, the paper sheet is fed only 0.99 inch by 120 pulses. Accordingly, the paper feeding of 1 inch requires:

$$120/0.99 = 121.2 \text{ pulses}$$

Since 1 inch equals twice the distance between successive feed hole start positions, therefore, the number of pulses between feed-hole start positions should alternate between 60 and 61, the frequency of occurrence of the two numbers being nearly equal.

Excess and deficiency in such numbers of pulses between the respectively adjacent feed hole start positions are cumulated. When the cumulative value (cumulative number of excessive and deficient pulses) has exceeded a certain allowable range, the number of paper feeding pulses is adjusted in order to correct the excess or deficiency. Since there is an indefinite region at the detecting point of the feed hole start position, the number of pulses between the feed hole start positions fluctuates to some extent. The fluctuating component is set as the allowable range of the cumulative number of excessive and deficient pulses.

The cumulative number of excessive and deficient pulses falling below the allowable range signifies that a predetermined length has been fed by fewer pulses than would be required if the distance per pulse were consistently equal to the nominal 1/120 of an inch. Therefore, when the regular number of pulses is given as an instruction, the paper sheet is fed excessively. Accordingly, the number of pulses actually applied needs to be reduced in accordance with the cumulative number of excessive and deficient pulses.

If the distance between lines is 1/6 inch, the number of pulses corresponding thereto is 20, and 1 pulse can be extracted by performing the new-line or return operation with 19 pulses. When, in order to extract 2 pulses, the number of pulses for the new-line operation is set at 18 so as to remove both pulses between the same lines, the shortened line space of the new line is conspicuous. Therefore, the line feeding of 19 pulses is carried out twice so as to extract 2 pulses in total. In this manner, corrections should preferably be dispersed among a plurality of lines as far as possible.

Conversely, the cumulative number of excessive and deficient pulses exceeding the allowable range signifies that pulses in a number larger than the regular number have been required for feeding the predetermined length. Therefore, when the regular number of pulses is given as an instruction, the amount of paper feeding becomes smaller. Accordingly, a number of pulses equal to this cumulative number of excessive and deficient pulses need to be inserted somewhere.

In the case where the amount of paper feeding for starting a new line is 1/6 inch, the number of pulses corresponding thereto is 20, and 1 pulse can be inserted by performing the new-line or return operation with 21 pulses. When, in order to insert 2 pulses, the number of pulses for the new-line operation is set at 22 so as to insert both pulses between the same lines, the lengthened line space of the new line is conspicuous. Therefore, the line feeding of 21 pulses is carried out twice so as to insert 2 pulses in total. In this manner, corrections should preferably be dispersed among a plurality of lines as far as possible.

The process for correcting the paper feeding error will be explained using respective concrete examples as to a case where the amount of paper feeding is excessive (Example 1), a case where it is deficient (Example 2) and a case where excess and deficiency appear alternately (Example 3).

EXAMPLE 1 IN WHICH AMOUNT OF PAPER FEEDING IS EXCESSIVE

FIG. 4A shows an example in which the feeding error is 1%. In consequence of the feeding, printing shifts down little by little, and the 66th line shifts downwards by $$11 \text{ inches} \times 1\% = 0.11 \text{ inch}$$

and extends to the next page (1004 in FIG. 4A).

If, the amount of paper actually fed is decreased by 1% with the foregoing method, the paper feeding error is corrected and the shift of the printing does not take place (FIG. 4B). That is, although the regular number of pulses required for starting a new line is 20, new-line operations based on 19 pulses are sometimes interwoven to correct what would otherwise be excessive paper fed. Numerals indicated at a part 1008 in FIG. 4B denote the numbers of paper feeding pulses required for the individual new-line operations. This process will be more concretely described in conjunction with a table in FIG. 5.

In the table of FIG. 5, the expression "total number of feeding pulses" signifies the number of paper feeding pulses counted since the start of the printing of the first page.

It is assumed that the first feed hole start position (1007 in FIG. 4B) has been detected at the 10th pulse (the 10th pulse in the total number of feeding pulses). It is also assumed that the next feed hole start position has been detected at the 70th pulse and that the feed hole start position after that has been detected at the 129th pulse. Then, the paper feeding has been performed with 60 pulses from the first feed hole start position to the second feed hole start position and performed with 59 pulses therefrom to the third feed hole start position. That is, the measured inter-hole distance between the second and third feed holes in 59 pulses. Since the distance from the first feed hole start position to the third feed hole start position corresponds to intervals between successive feed hole start positions (=1 inch), actually the paper feeding of 1 inch has been effected with:

$$60+59=119 \text{ pulses}$$

Therefore, the average paper feed per pulse has been 1/119 inch, which is slightly greater than 1/120 inch. Therefore, the number of pulses, namely, 120, nominally required to advance a paper sheet by 1 inch is actually one pulse too many (the hole-position deviation $=+1$).

Further, the paper feeding has been performed with 60 pulses to the next feed hole start position and then with 59 pulses to the next feed hole start position after that. Therefore, when the feeding pulses are counted from the first feed hole start position, actually the paper feeding of 2 inches has been performed with 238 pulses. Herein, it is considered that the average amount of paper feeding per pulse has been 2/238 inch in the interval of 2 inches. Therefore, an instruction to the apparatus to cause it to generate the number of pulses, namely, 240, nominally required to advance the paper sheet by 2 inches actually results in two pulses too many (the hole-position deviation $=+2$).

When the paper feeding is performed on and on in this manner, the numbers of excessive pulses are accumulated. That is, the excessive paper feeding continues to proceed. Accordingly, when the hole-position deviation exceeds a certain range, the numbers of pulses to be given as instructions to advance the paper to successive print lines are decreased by a line-position adjustment to successively absorb the amount of excessive paper feeding, whereby the advancement discrepancy can be corrected.

The table of FIG. 5 illustrates a case where the allowable range of the advancement discrepancy is set at $+1$. When the advancement discrepancy has exceeded this allowable range, that is, when the cumulative number of excessive and deficient pulses has become $+2$, the number of paper feeding pulses for the next new-line operation is decreased by 1. In this example, the advancement discrepancy has become $+2$ at the fifth feed hole start position (248th pulse in the total number of feeding pulses). At this time, therefore, the new-line operation of the 13th line is effected with 19 pulses, which is one pulse less than the number nominally required to advance to a subsequent print line. Then, when the printing of the 14th line is started, the advancement discrepancy is corrected by 1 pulse and becomes:

$$+2-1=+1 \text{ pulse}$$

Now, since the number of pulses between the fifth feed hole start position (the 248th pulse) and the sixth feed hole start position has been 60, the excess or deficiency of the number of pulses in this section is null, and the advancement discrepancy is $+1+0=+1$ pulse.

Further, since the number of pulses to the succeeding seventh feed hole start position (367th pulse) is 59, the difference between the nominal interhole distance and the measured inter-hole distance in this section is $+1$. Accordingly, the advancement discrepancy becomes $+1+1=+2$ and exceeds the allowable range.

Accordingly, the number of paper feeding pulses of the 19th line is decreased by a line-position adjustment of 1 so as to effect the new-line operation with 19 pulses. Then, when the printing of the 20th line is started, the advancement discrepancy becomes:

$$+2-1=+1$$

In this manner, the new-line operation of 19 pulses is interwoven (FIG. 4B) each time the advancement discrepancy exceeds a certain value, whereby the paper feeding error corresponding to 1% is absorbed. Accordingly, the advancement discrepancy is always held within the paper feeding length equivalent to 1 pulse.

As understood from the table of FIG. 5, the number of pulses required for the paper feeding of 1 page (11 inches) is 1307 and is about 1% smaller than the number of pulses nominally for 1 page ($120\times1=1320$ pulses). Thus, the amount of paper fed has been corrected to be about 1% smaller on the average.

EXAMPLE 2 IN WHICH AMOUNT OF PAPER FEEDING IS DEFICIENT

We now turn to a description of the way in which the apparatus corrects for a situation in which paper feed is less than the amount that nominally should result from the number of pulses commanded.

Figure 6A:
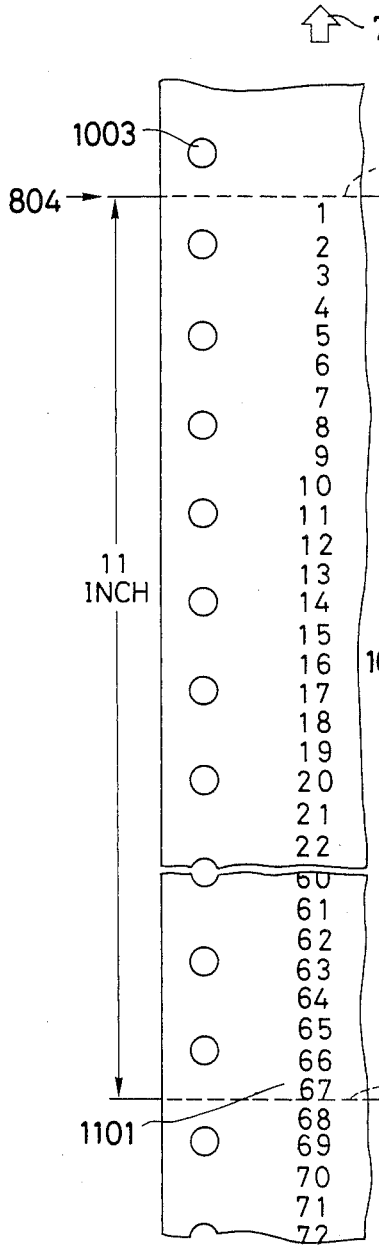
FIG. 6A is a diagram showing the state in which a sheet of paper has been underfed by 1%.

FIG. 6A shows an example in which the paper feed is 1% less than nominal (feeding error of −1%). In consequence of the feeding, printing shifts up little by little, the 66th line shifts upwards by $$11 \text{ inches}\times1\%=0.11 \text{ inch}$$

and this page of the paper sheet comes to contain the first line of the next page (at numeral 1101 in FIG. 6A).

Figure 6B:
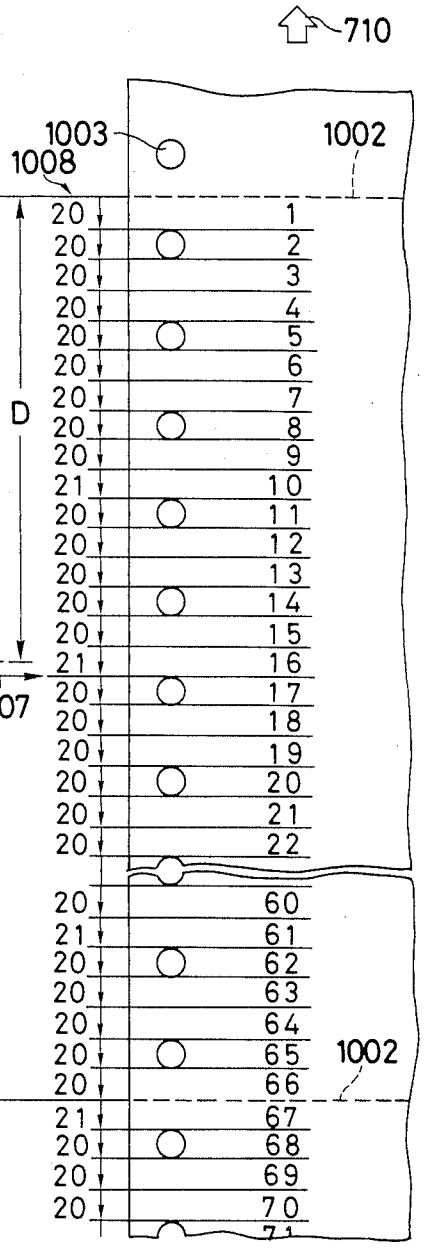
FIG. 6B is a diagram showing the state in which a paper feeding error has been corrected.

FIG. 6B depicts the correction of this feeding error by increasing the actual paper feed by 1%. That is, although the number of pulses nominally required for the new-line or return operation is 20, new-line operations based on 21 pulses are sometimes interwoven to correct what would otherwise be insufficient paper feed. This process will be more concretely described in conjunction with a table in FIG. 7.

It is assumed that the first feed hole start position (1007 in FIG. 6B) has been detected at the 10th pulse (the 10th pulse in the total number of feeding pulses). Since 60 pulses have been included therefrom to the second feed hole start position and 61 pulses to the third feed hole start position, actually the paper feeding for 2 sections of the feed hole start positions (=1 inch) has been effected with:

$$60+61=121 \text{ pulses}$$

Herein, it is considered that the average amount of paper feeding per pulse has been 1/121 inch, which is slightly less than 1/120 inch.

Therefore, an instruction commanding the number of pulses, namely, 120, nominally required to advance the paper by one inch actually results in a number of pulses that is one less than that required to produce the desired one-inch advance (cumulative number of excessive and deficient pulses = −1).

Further, the number of feeding pulses to the fourth feed hole start position is 61. Therefore, when the feeding pulses are counted from the first feed hole start position, actually the paper feeding of 1.5 inch has been performed with 182 pulses. Herein, it is considered that the average amount of paper fed per pulse has been $$1.5/182 \text{ inch}=1/121.3 \text{ inch}$$

in this interval of 1.5 inch. an instruction commanding the number of pulses, namely, 180, nominally required to advance the sheet by 1.5 inches is actually two pulses too few (cumulative number of excessive and deficient pulses = −2).

When the paper feeding is performed on and on in this manner, the numbers of deficient pulses are accumulated. That is, the deficient amounts of paper feeding are accumulated.

Accordingly, in a case where the accumulated number of deficient pulses has exceeded a certain range, the numbers of pulses to be given as instructions to advance to successive new print lines are increased to successively compensate for what would otherwise be insufficient paper feed, whereby the error of the paper feeding can be corrected.

The table of FIG. 7 illustrates a case where the allowable range of the number of deficient pulses is set at −1. When the accumulated number of deficient pulses has exceeded this allowable range, that is, when the cumulative number of excessive and deficient pulses has become −2, the number of paper feeding pulses for the new-line operation is increased by 1. More specifically, the cumulative number of the excessive and deficient pulses has become −2 at the 192nd pulse, which is the fourth feed hole start position. At this time, therefore, the new-line operation of the 10th line is effected with 21 pulses which is one pulse more than the nominal number of pulses for a new-line operation. Then, when the printing of the 11th line is started, the cumulative number of excessive and deficient pulses is corrected by 1 pulse and becomes:

$$-2+1=-1 \text{ pulse}$$

Now, since the number of pulses to the fifth feed hole start position (the 252nd pulse) has been 60, the excess or deficiency of the number of pulses in the corresponding section is null. Accordingly, the cumulative number of excessive and deficient pulses becomes $$-1+0=-1$$

and does not exceed the allowable range.

Next, since the number of pulses between the sixth feed hole start position (the 313th pulse) and the preceding feed hole start position has been 61, the excess or deficiency of the number of pulses in this section is −1 pulse, and the cumulative number of excessive and deficient pulses becomes:

$$-1-1=-2 \text{ pulses}$$

Since the allowable range has been exceeded again, the new-line operation of the 16th line is performed with 21 pulses being which is one pulse more than the number nominally required to advance by one print line. Then, when the printing of the 17th line is started, the cumulative number of the excessive and deficient pulses is corrected by 1 and becomes:

$$-2+1=-1$$

In this manner, the new-line operation of 21 pulses is interwoven (FIG. 6B) each time the cumulation of the feeding errors exceeds a certain value, whereby the deficient component of paper feeding equal to 1% is compensated for. Accordingly, the feeding error is always held within the paper feeding length equivalent to 1 pulse.

As understood from the table of FIG. 7, the number of pulses nominally required for the paper feeding of 1 page (11 inches) is 1333 and is about 1% larger than the number of pulses for 1 page ($120\times11=1320$ pulses). Thus, the amount of paper feed has been corrected to be about 1% larger on the average.

EXAMPLE 3 IN WHICH EXCESS AND DEFICIENCY IN AMOUNT OF PAPER FED APPEAR ALTERNATELY

It is sometimes the case that excess and deficiency in paper feed appear alternately due to the eccentricity of a feeding roller, the partial expansion or contraction of the sheet of paper, nonuniformity in the coefficient of friction between the roller and the paper sheet, and so forth. An example of a process for correcting the amount of paper fed in this case will be described with reference to tables in FIGS. 8 and 9. In this example, the allowable values of the cumulative numbers of excessive and deficient pulses are set at $\pm1$ pulse.

It is assumed that the first feed hole start position (1007 in FIG. 8) have been detected at the 10th pulse. Since 60 pulses have been included therefrom to the second feed hole start position, the cumulative number of excessive and deficient pulses to this position is null. Further, since 59 pulses have been included therefrom to the third feed hole start position, the cumulative number of excessive and deficient pulses to this position is :

$$0+1=+1$$

Since the number of pulses to the fourth feed hole start position is 60, the cumulative number of excessive and deficient pulses is $+1+0=+1$;

since the number of pulses to the fifth feed hole start position is 61, the cumulative number of excessive and deficient pulses is $+1-1=0$;

since the number of pulses to the sixth feed hole start position is 61, the cumulative number of excessive and deficient pulses is $0-1=-1$; and since the number of pulses to the seventh feed hole start position is 61, the cumulative number of excessive and deficient pulses becomes $-1-1=-2$ and exceeds the allowable range.

Accordingly, the number of pulses for the new-line operation of the 19th line is set at 21 here.

Then, when the printing of the 20th line is started, the cumulative number of excessive and deficient pulses becomes:

$$-2+1=-1$$

Owing to such a control, the paper feeding error is always held within the paper feeding length equivalent to 1 pulse.

Figure 8:
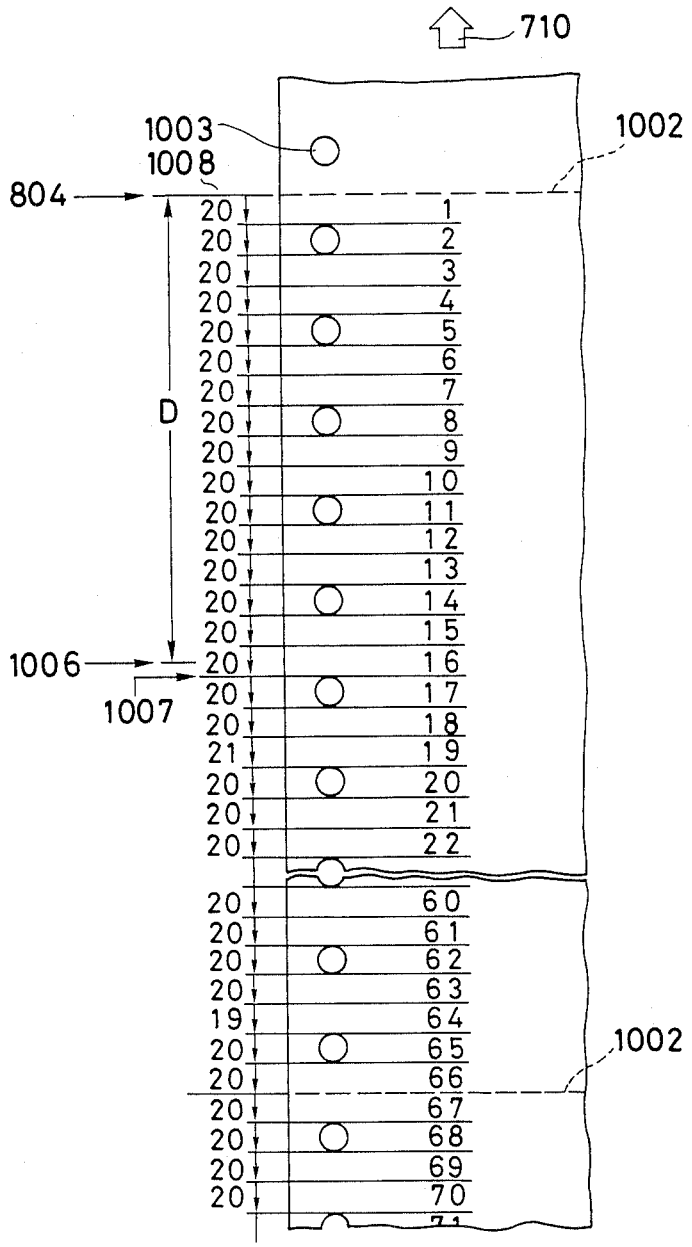
FIG. 8 is a diagram showing the state in which a paper feeding error has been corrected when excess and deficiency in the amount of paper feeding have appeared alternately.

The situation of the new-line operations is shown in FIG. 8. Numerals indicated at a part 1008 denote the numbers of paper feeding pulses required for the individual new-line operations.

In the above, the paper-feed control according to the first embodiment has been described.

FLOW CHART BASED ON FIRST EMBODIMENT

Figure 10A:
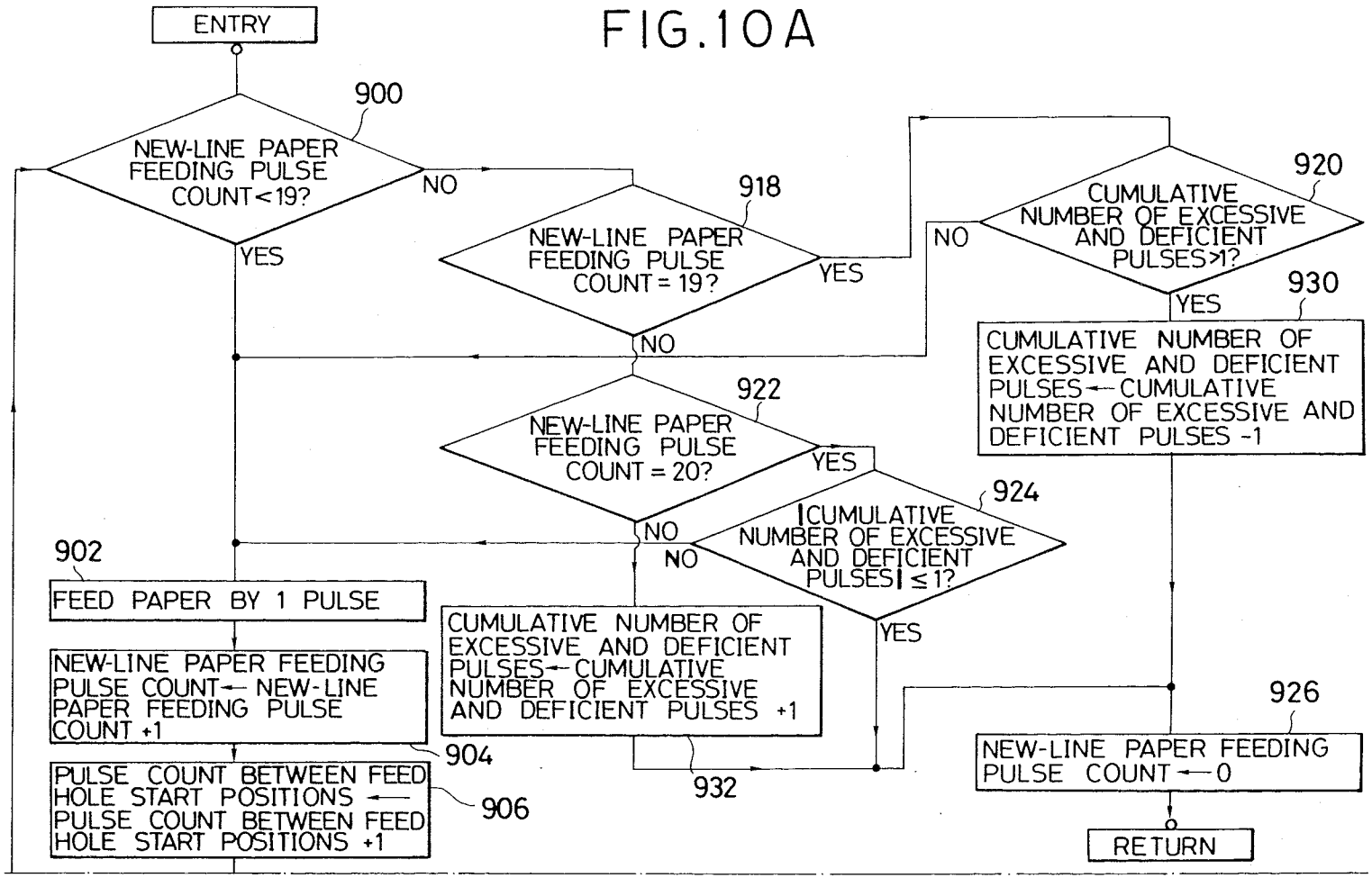

An example of the flow chart of the paper-feed control is shown in FIG. 10.

The flow chart illustrates the subroutine of a single operation of new-line processing, and this subroutine is called every new-line operation. That is, this subroutine is called when the new-line operation is to be performed after the end of printing for one line.

In the flow chart, the expression "new-line paper feeding pulse count" signifies the counted value of the number of pulses in which the sheet of paper has already been fed in the single operation of new-line processing.

The expression "pulse count between feed hole start positions" signifies the counted numerical values of pulses between the current position of the paper sheet and the feed hole start position immediately before it.

The expression "standard pulse number between feed hole start positions" signifies the number of pulses which is required to feed a paper the one-half inch between feed hole start position in the absence of any paper feeding error. In this example, the designed value of the paper feeding length of 1 pulse (the value in the absence of any paper feeding error) is 1/120 inch, and hence, the standard pulse number between the feed hole start positions in:

$$\tfrac{1}{2}\text{inch}\div1/120=60\text{ pulses}$$

The expression "initial start flag" signifies a flag for indicating that the apparatus is in the initial state thereof. It is set in the initial state of the apparatus (initial state flag=1), and it is reset after the first feed hole start position since the start of the operation of the apparatus has been detected (initial state flag=0 is established).

The other numerical values are zero in the initial state Now, the flow chart of FIG. 10 will be described in detail.

There will be explained a flow from the start of the operation of the apparatus until the detection of the first feed hole start position. At the time of the start, as stated above, the initial state flag is equal to 1, and the new-line paper feeding pulse count, the pulse count between the feed hole start positions and the cumulative number of excessive and deficient pulses are all reset to zero.

The flow proceeds from ENTRY to a step 900. Since the new-line paper feeding count is zero at the start of the operation, the flow proceeds to a step 902. The sheet of paper is fed by 1 pulse at step 902, which is followed by a step 904. Since the paper sheet has been fed by 1 pulse at the step 902, the new-line paper feeding pulse count with 1 added thereto is set as a new-line paper feeding pulse count at the step 904, and further, the pulse count between the feed hole start positions with 1 added thereto is set as a pulse count between the feed hole start positions at a step 906. Thereafter, the flow proceeds to a step 908. At the step 908, feed hole start position has not been detected yet, so that the flow returns to step 900.

Thenceforth, in the same manner, the feeding of the paper sheet is carried out, and each time the paper sheet is fed by 1 pulse, the new-line paper feeding pulse count and the pulse count between the feed hole start position are incremented by 1.

Assuming that the paper sheet has been fed by 9 pulses, both the new-line paper feeding pulse count and the pulse count between the feed hole start positions are 9.

Subsequently, the flow proceeds from step 900 to step 902, at which the paper sheet is fed by 1 pulse, whereupon the new-line paper feeding pulse count and the pulse count between the feed hole start positions are both rendered 10 at the respective steps 904 and 906.

Assuming that the first feed hole start position has been detected at step 908, the flow proceeds to a step 910. Since the initial state flag is equal to 1 at step 910, the flow proceeds to a step 912, at which the initial state flag=0 is established. Further, at a step 916, the pulse count between the feed hole start positions is reset to zero, and the flow returns to step 900.

In the above way, the first feed hole start position is detected, and after the detection, the new-line paper feeding pulse count is 10 and the pulse count between the feed hole start positions is 0. The cumulative number of excessive and deficient pulses undergoes no change, and therefore remains zero. Additionally, the initial state flag becomes zero.

Next, a flow after the detection of the first feed hole start position will be described. The ensuing description will besides a case where the amount of paper feeding is accurate (Example 1), a case where it is excessive (Example 2) and a case where it is deficient (Example 3).

1 IN WHICH AMOUNT OF PAPER FEEDING IS ACCURATE

The same flow as stated above proceeds along the steps 900→ 902→ 904→ 906→ 908→ 900, and this closed loop is repeated. Thus, the sheet of paper is fed every pulse, and the new-line paper feeding pulse count and the pulse count between the feed hole start positions are incremented one by one.

Assuming that the paper sheet has been fed by 9 pulses, the new-line paper feeding pulse count is 19, and the pulse count between the feed hole start positions is 9.

On this occasion, the flow proceeds from step 900 to a step 918. Step 918 is followed by a step 920 because the new-line paper feeding pulse count is 19. Since, at this time, the amount of paper feeding is accurate, the cumulative number of excessive and deficient pulses is 0, and hence, the flow proceeds to step 902. Then, the paper sheet is fed by 1 pulse at step 902, the new-line paper feeding pulse count is rendered 20 at step 904, and the pulse count between the feed hole start positions is rendered 10 at step 906. Thereafter, the flow proceeds from step 906 to step 908 and returns to step 900.

The flow proceeds from step 900 to the step 918, and since the new-line paper feeding pulse count is 20, the flow proceeds to a step 922 and further to a step 924. Since, at step 924, the cumulative number of excessive and deficient pulses is 0, the flow proceeds to a step 926, at which the new-line paper feeding pulse count is reset to 0.

In the above way, the paper sheet is fed by 20 pulses to effect the new-line operation, and the paper feeding gets out of the subroutine through RETURN to end the new-line operation of the first line. At this time, the new-line paper feeding pulse count=0, the pulse count between the feed hole start positions=10, and the cumulative number of excessive and deficient pulses remains 0.

After the printing of the second line has ended, this subroutine is called again for the paper feeding of a new-line operation, and the new-line processing of the second line is started from th point ENTRY. As in the flow described above, the paper sheet is further fed by 20 pulses to perform the new-line operation (the new-line operation of the second line has ended). At this time, the pulse count between the feed hole start positions=30. Further, assuming that the paper sheet have been fed by 19 pulses, the flow proceeds along the steps 908→ 900→ 918→ 920→ 902 because the feed hole start position has not been detected yet. The paper sheet is fed by 1 pulse at step 902, the new-line paper feeding pulse count becomes 20 at step 904, and the pulse count between the feed hole start positions becomes 50 at step 906. On this occasion, the next feed hole start position has not been detected yet. Therefore, the flow proceeds from step 906 via step 908 back to step 900 and then proceeds along steps 918→ 922→ 924→ 926, whereupon the paper feeding gets out of the subroutine from the point RETURN (the new-line operation of the third line has ended).

Subsequently, the new-line operation of the fourth line is started. The flow starts from the point ENTRY, and the loop of the steps 900→ 902→ 904→ 906→ 908→ 900 is repeated 9 times. In the tenth repetition of the loop, the number of pulses between the feed hole start positions becomes 60 at step 906, and the paper feed is accurate, so that the feed hole start position is just detected at the next step 908. Therefore, step 908 is followed by step 910.

Since the initial state flag=0 at step 910, the flow proceeds to a step 927, at which the cumulative number of excessive and deficient pulses is calculated. More specifically, (the standard number of pulses between the feed hole start positions (=60−the pulse count between the feed hole start positions) is first evaluated. Since, in this case, the pulse count between the feed hole start positions=60, the above value, i.e., the standard number of pulses between the feed hole start positions minus the pulse count between the feed hole start positions, becomes 60−60 (=0). Secondly, this result 0 is added to the cumulative number of excessive and deficient pulses (=0) held before, whereby the cumulative number of excessive and deficient pulses is rendered 0 anew. Step 927 is followed by a step 928, at which the pulse count between the feed hole start positions is reset to 0, whereupon the flow returns to step 900.

Since, at this time, the new-line paper feeding pulse count is 10, it becomes 20 when the loop of the steps 900→ 902→ 904→ 906→ 908→ 900 is further repeated 10 times. Accordingly, the flow proceeds along the steps 900→ 918→ 922→ 924. Since the cumulative number of excessive and deficient pulses at the step 924 is 0, the flow proceeds from step 924 to step 926, at which the new-line paper feeding pulse count is reset to 0. Then, the paper feeding gets out of the subroutine from the point RETURN, and the new-line operation of the fourth line has ended with 20 pulses. Subsequently, after the printing of the fifth line has ended, the subroutine is called again, and the processing of the new-line paper feeding of the fifth line is started from the point ENTRY.

As thus far described, in the case where the paper feed is accurate, the new-line operation is performed each time the new-line paper feeding pulse count is 20, and the detection of the feed hole start position is done each time the pulse count between the feed hole start positions is 60. Accordingly, the cumulative number of excessive and deficient pulses is 0.

2 IN WHICH AMOUNT OF PAPER FEEDING IS EXCESSIVE

It is assumed that the paper feeding has been performed with 60 pulses from the first feed hole start position to the second feed hole start position, with 59 pulses thereform to the third feed hole start position, with 60 pulses therefrom to the fourth feed hole start position, and with 59 pulses therefrom to the fifth feed hole start position.

In this case, at step 927 after the fifth feed hole start position has been detected at step 908, the cumulative number of excessive and deficient pulses held before is:

$$(60-60)+(60-59)+(60-60)=+1$$

so that the cumulative number of excessive and deficient pulses is further updated to:

$$+1+(60-59)=+2$$

Subsequently, the flow returns to step 900 via the step 928. This state is the state corresponding to the 248th pulse in terms of the total number of feeding pulses in FIG. 5. Under this state, the new-line paper feeding of the 13th line is proceeding, and the new-line paper feeding pulse count=8 and the pulse number between the feed hole start positions =0.

Subsequently, likewise to the foregoing, the flow proceeds along the steps 900→ 902→ 904→ 906→ 908→ 900, and this closed loop is repeated. Thus, the sheet of paper is fed every pulse, and the new-line paper feeding pulse count and the pulse count between feed hole start positions are incremented one by one.

Assuming that the sheet of paper have been fed by 11 pulses, the new-line paper feeding pulse count is 19, and the pulse count between the feed hole start positions is 11.

On this occasion, the flow proceeds along the steps 900→ 918→ 920. Since, in this case, the amount of paper fed is excessive, the cumulative number of excessive and deficient pulses is 2, and hence, the flow proceeds to a step 930. At this step 930, 1 is subtracted from the cumulative number of excessive and deficient pulses (=2) so as to set a new cumulative number of excessive and deficient pulses (+1), whereupon the flow proceeds to the step 926. The new-line paper feeding pulse count (19 before being reset) is reset to 0 at step 926, and the paper feeding gets out of the subroutine from the point RETURN. Accordingly, the paper feeding has been performed with 19 pulses, that is, the number of paper feeding pulses can be decreased by 1 in the new-line operation. Thus, the cumulative number of excessive and deficient pulses is corrected by 1 and becomes:

$$+2-1=+1 \text{ pulse (refer to th step 930)}$$

After the printing of the 14th line has been carried out, this subroutine is called again and the new-line paper feeding processing of the 14th line is started from the point ENTRY.

As thus far described, in the case of the excessive paper feed, when the cumulative number of excessive and deficient pulses has become +2, the new-line operation is performed by the paper feeding of 19 pulses, so that the cumulative number of excessive and deficient pulses becomes +2−1=+1 and is corrected by 1 pulse. It is accordingly understood that the paper feeding is precisely controlled.

3 IN WHICH AMOUNT OF PAPER FEEDING IS DEFICIENT

It is assumed that the paper feeding has been performed with 60 pulses from the first feed hole start position to the second feed hole start position, with 61 pulses therefrom to the third feed hole start position, and with 61 pulses therefrom to the fourth feed hole start position.

In this case, at step 927 after the fourth feed hole has been detected at step 908, the cumulative number of excessive and deficient pulses held before is:

$$(60-60)+(60-61)=-1$$

so that the cumulative number of excessive and deficient pulses is further updated to:

$$-1+(60-61)=2$$

Subsequently, the flow returns to step 900 via step 928. This state is the state corresponding to the 192nd pulse in terms of the total number of feeding pulses in FIG. 7. Under this state, the new-line paper feeding pulse count=12 and the pulse number between feed hole start positions=0.

Subsequently, likewise to the foregoing, the flow proceeds along the steps 900→ 902→ 904→ 906→ 908→ 900, and this closed loop is repeated. Thus, the sheet of paper is fed every pulse, and the new-line paper feeding pulse count and the pulse count between the feed hole start positions are incremented one by one.

Assuming that the sheet of paper has been fed by 7 pulses, the new-line paper feeding pulse count is 19, and the pulse count between the feed hole start positions is 7.

Or this occasion, the flow proceeds along the steps 900→ 918→ 920. Since, in this case, the amount of paper fed is deficient, the cumulative number of excessive and deficient pulses is 31 2. Therefore, the flow proceeds from step 920 to step 902 and then along the steps 902→ 904→ 906→ 908. Thus, the paper sheet is further fed by 1 pulse, and the new-line paper feeding pulse count becomes 20, while the pulse count between the feed hole start positions becomes 8. The flow returns from step 908 to the step 900. Since, in this case, the new-line paper feeding pulse count is 20, the flow proceeds along the steps 900→ 918→ 922→ 924. At step 924, the cumulative number of excessive and deficient pulses is −2, so that the flow proceeds from step 924 to step 902 and further proceeds along steps 902→ 904→ 906→ 908. Thus, the paper sheet is further fed by 1 pulse, and the new-line paper feeding pulse count and the pulse count between the feed hole start positions become 21 and 9 respectively.

Thereafter, the flow returns from step 908 to step 900. Since, in this case, the new-line paper feeding pulse count is 21, the flow proceeds along the steps 900→ 918→ 922→ 932. At step 932, the cumulative number of excessive and deficient pulses (−2) has 1 added thereto and is rendered a new cumulative number of excessive and deficient pulses (−1), whereupon the flow proceeds to step 926. The new-line paper feeding pulse count (21 before being reset) is reset to 0 at step 926, and the paper feeding gets out of the subroutine from the point RETURN.

Accordingly, the paper feeding has been performed with 21 pulses, that is, the number of paper feeding pulses can be increased by 1 in the new-line operation. Thus, the cumulative number of excessive and deficient pulses is corrected by 1 and becomes:

$$-2+1=-1 \text{ (refer to step 932)}$$

As thus far described, in the case of the deficient amount of paper feeding, the new-line operation is performed by the paper feeding of 21 pulses, so that the cumulative number of excessive and deficient pulses become $-2+1=-1$ and is corrected by pulse. It is accordingly understood that the paper feeding is precisely controlled.

As described above in detail, according to the flow chart of FIG. 10, the paper feeding amount control based on the first embodiment can be well understood. That is, in the case where the amount of paper feeding is excessive or deficient, it can be adjusted and precisely controlled.

BLOCK CIRCUIT BASED ON FIRST EMBODIMENT

Figures 11, 11A:
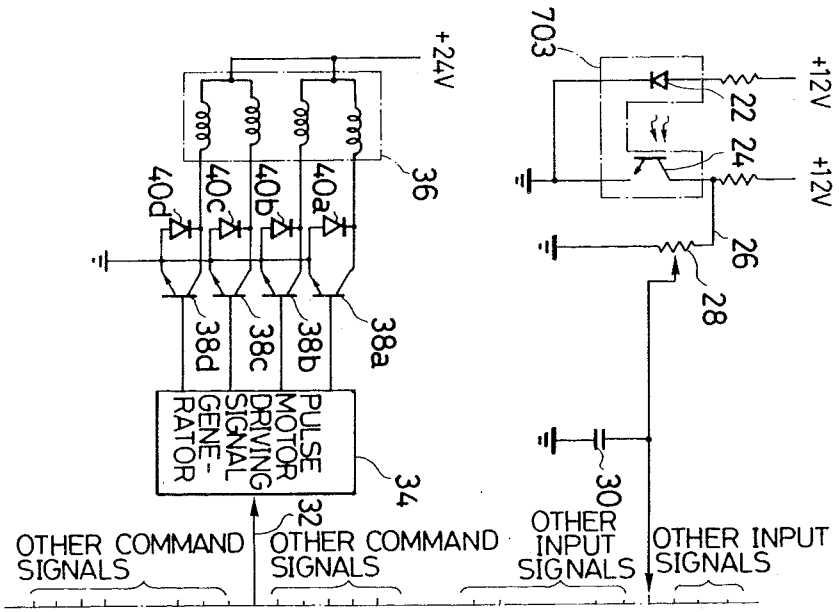
FIGS. 11A and 11B, when connected as shown in FIG. 11 show a block circuit diagram for performing the paper feeding amount control of the first embodiment.
Figure 11B:
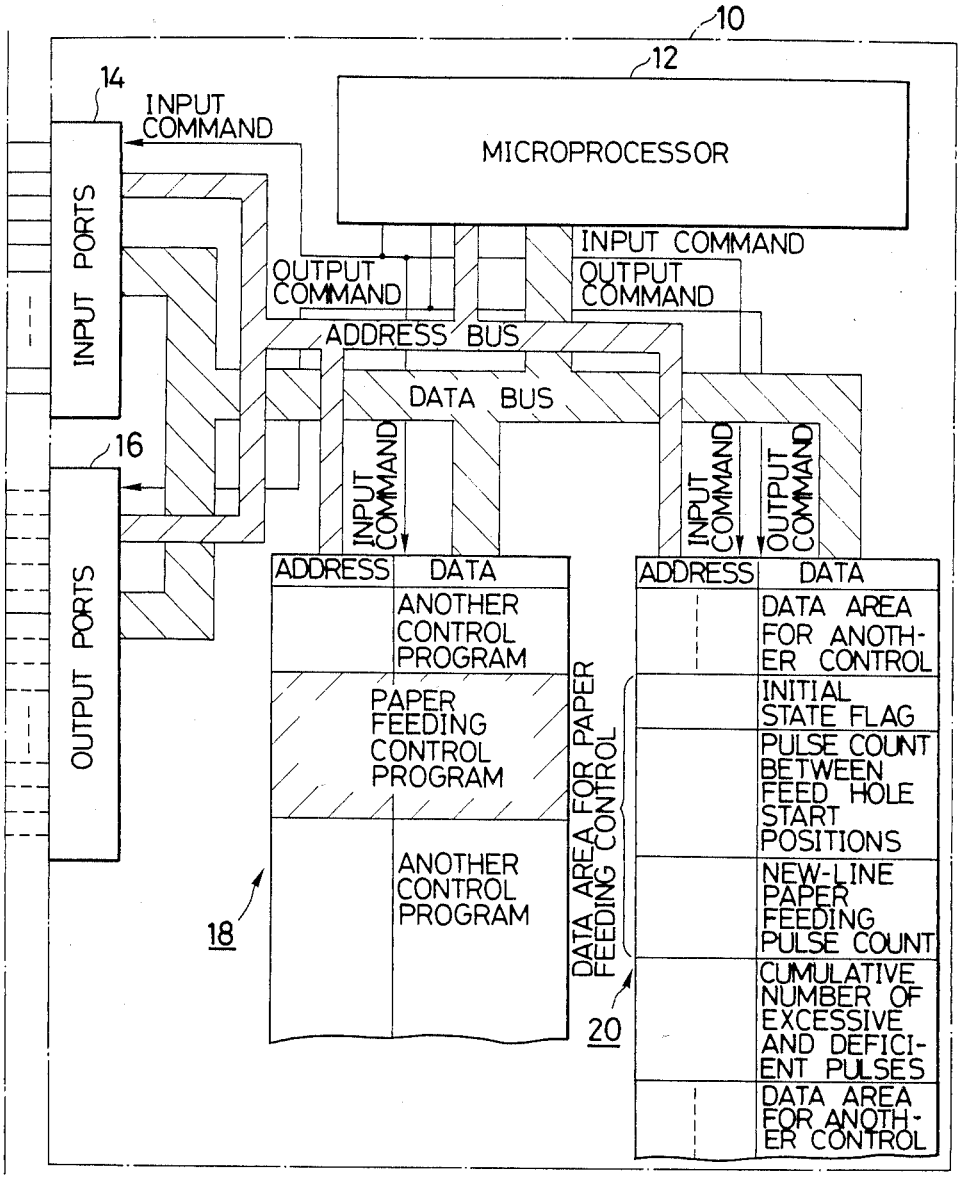

Next, an example of a block circuit for controlling paper feed is shown in FIG. 11. The processing of the flow chart in FIG. 10 is executed by the block circuit in FIG. 11.

FIG. 11 is a block diagram of feed circuitry for the first embodiment, in which a control circuit 10 is built is the apparatus such as a printer, with the transmission type optical sensor 703 and a pulse motor. This control circuit 10 is contructed of a microprocessor 12 and the peripheral circuits thereof. That is, the control circuit 10 includes the microprocessor 12, input ports 14, output ports 16, a ROM 18 and a RAM 20.

The transmission type optical sensor 703 includes a light emitting diode 22 and a photodiode 24. A feed hole detection signal 26 from the photodiode 24 is supplied to one of the input ports 14 through a variable resistor 28 for setting a threshold value. The feed hole detection signal 26 is also grounded through a capacitor 30 for eliminating noise.

The control circuit 10 performs the processing illustrated in the flow chart of FIG. 10, and delivers a command signal 32 for driving the pulse motor by 1 step from one of the output ports 16. This command signal 32 is converted by a pulse motor driving signal generator 34 into any of a series of signals for exciting the respective phases of the pulse motor. More specifically, pulse motor driving transistors 38*a*, 38*b*, 38*c* and 38*d* and diodes 40*a*, 40*b*, 40*c* and 40*d* are interposed between the pulse motor driving signal generator 34 and the pulse motor 36, and the respective phases of the pulse motor 36 are excited by the pulse motor driving signal generator 34, whereby the pulse motor 36 is driven to rotate step by step.

The ROM (read only memory) 18 within the control circuit 10 stores therein a program for controlling the apparatus, in a part of which a subroutine program for executing the processing of the flow chart in FIG. 10 is included.

In addition, the RAM (random access memory) 20 has an area for data items required for the paper feeding control. These data items are the initial state flag, the pulse count between feed hole start positions, the new-line paper feeding pulse count and the cumulative number of excessive and deficient pulses.

The microprocessor 12, input ports 14, output ports 16, ROM 18 and RAM 20 are connected and associated by an address bus, a data bus, input command signals and output command signals. Such is one of the most standard arrangements of control circuits employing microprocessors. According to the flow chart shown in FIG. 10, the mircoprocessor 12 receives data from the selected parts of the input ports 14, ROM 18 and RAM 20 via the address bus, processes the data and delivers outputs to the selected parts of the output ports 16 and RAM 20 via the address bus again. That is, the microprocessor 12 decides the presence or absence of the feed hole detection signal 26 and rewrites data within the RAM 20, thereby to perform the flag control and obtain the several pulse counts and to give an appropriate pulse motor drive command.

The processes to which the microprocessor 12 subjects the data in the control are to set (bring the flag to '1') and reset (bring the flag to '0') the initial state flag, to reset (return the numerical value to '0') and count up (increase the numerical value by 1) the pulse count between the feed hole start positions, to reset and count up the new-line paper feeding pulse count, and to reset, count up and count down (decrease the numerical value by 1) the cumulative number of excessive and deficient pulses.

As thus far explained, the block circuit of FIG. 11 can realize the processing of the flow chart in FIG. 10.

Second Embodiment

Next, the second embodiment of the present invention will be described. In the second embodiment, a paper feeding apparatus similar to the first embodiment (refer to FIGS. 1 and 2) is used, and a detection signal etc. similar to those in FIG. 3 are produced.

Paper Feeding Amount Control according to Second Embodiment

A method of precisely controlling the amount of paper fed in accordance with the second embodiment will be described with reference to FIGS. 12A, 12B, 12C, 12D, 12E and 12F. The second embodiment is characterized in that, under the initial state of paper feeding, the initial phase difference between the feed hole position of a sheet of paper and a feed hole detecting position is measured. The number of feed holes passing through the feed hole detecting position is counted as the paper is fed, and the paper is advanced by a length corresponding to the initial phase difference after the counted number of the feed holes has corresponded to one page of the paper sheet, so as to precisely effect the paper feeding of the length for one page of the paper sheet.

In FIGS. 12A–12F, numeral 804 designates an initial lateral perforation position, numeral 805 the printing position of a printer, and numeral 803 a feed hole detecting position.

First, the number of pulses is detected which corresponds to the deviation of the feed hole detecting position relative to a feed hole start position in the initial state of the printer. It shall be called the "number of initial phase pulses." More specifically, it is assumed that the paper sheet is initially at a position in FIG. 12A and that the first feed hole start position 1007 is detected at a position in FIG. 12B after the start of the operation of the printer, and it is assumed that the number of pulses sent to the pulse motor during the operation is A. The number 'c' is regarded as the standard number of pulses between the feed hole start positions, so the number of initial phase pulses I is:

$$I=C-A$$

The number of initial phase pulses I is the number of pulses by which the feed hole detecting position deviates from the feed hole start position downwards (in a direction opposite to a paper feeding direction) under the initial state.

It is assumed that the number of the feed holes for one page is H. When the paper sheet is further fed by I pulses after the H feed hole start positions have passed through the feed hole detecting position, it is considered that the paper feeding for one page have been performed. As to the next page, it is similarly considered that the paper feeding for further one page have been performed, when the paper sheet is further fed by I pulses after the H feed hole start positions have passed through the feed hole detecting position.

Figures 12A, 12B, 12C, 12D, 12E, 12F:
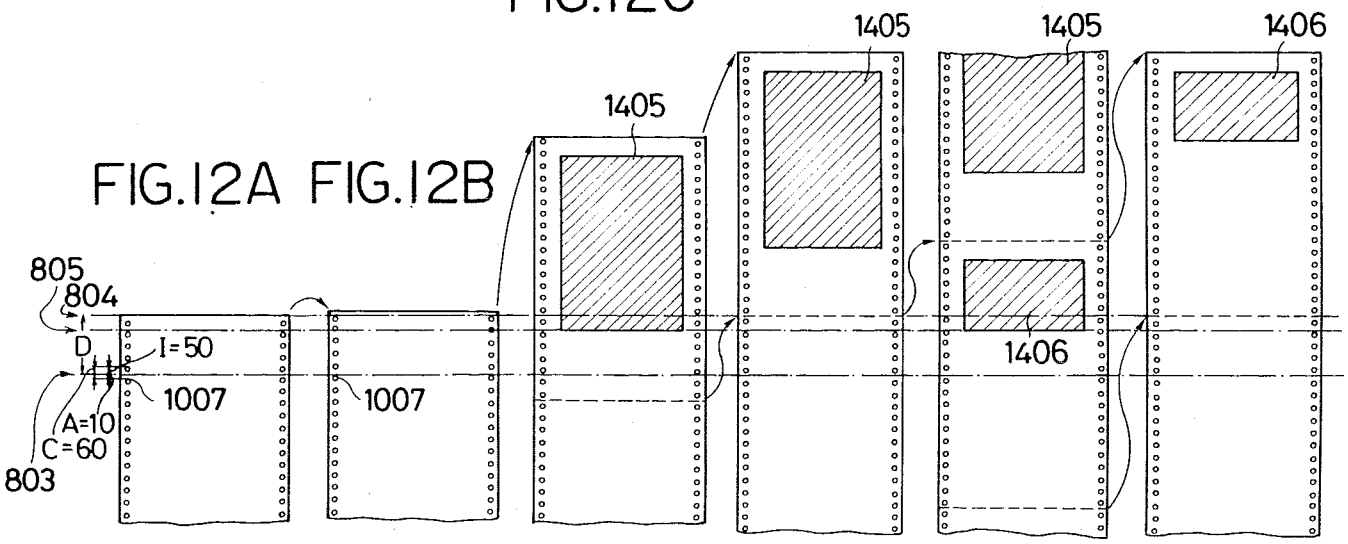
FIGS. 12A, 12B, 12C, 12D, 12E and 12F are diagrams showing a paper feeding amount control according to the second embodiment of the present invention.

Assuming by way of example that the first feed hole start position has been detected at the 10th pulse as reckoned from the initial state, the number of pulses A is 10 (FIG. 12B). In a case where the amount of paper fed per pulse is 1/120 inch, and feed holes occur every ½ inch, the standard number of pulses C between the feed hole start positions is 60. Accordingly, the number of initial phase pulses I becomes:

$$I=C-A=60-10=50$$

In addition, assuming the length of one page to be 11 inches, the number of the feed holes for one page is 22 on either edge, that is, H=22, because feed holes occur every ½ inch.

Referring now to FIG. 12C, a page-feeding instruction is given after the printing 1405 thereof has been completed. Fifteen feed hole start positions have already passed through the feed hole detecting position at this time. Therefore, when the page feeding for one page is ended at the point in time at which seven more feed hole start positions have passed through the feed hole detecting position and the paper feeding of 50 pulses has been further carried out, the position of the lateral perforated line at the end of this page comes to the initial lateral perforation position (FIG. 12D).

Next, in FIG. 12E, the printing of the second page has been performed. And, a page-feeding instruction is given after the printing 1406 thereon has been completed. At this time, 6 feed hole start positions have passed through the feed hole detecting position. Therefore, when the page feeding of the second page is ended at the point in time at which 16 more feed hole start positions have passed through the feed hole detecting position and the paper feeding of 50 pulses is further carried out, the position of the perforated line at the end of this page comes to the initial lateral perforation position again (FIG. 12F).

In this manner, though feeding errors accumulate within one page, they have no influence on the next page. The accumulation of the errors in one page increases more as the printing comes nearer to the end of the page. Since, however, ordinary documents are not printed on at several lines at the upper end and lower end of one page (the top margin and the bottom margin), the printing does not extend to the next page unless the accumulated feeding error is extraordinarily great.

As described above, according to the second embodiment, the feeding errors accumulate within one page, but do not affect the next page, so that the paper feeding is precisely controlled.

Feed Hole Detecting Method for Performing Paper Feeding Amount Control According to First and Second Embodiments In the above, the two paper feeding control methods have been explained. Next, a few examples will be mentioned of the method for detecting feed holes.

Figure 13:
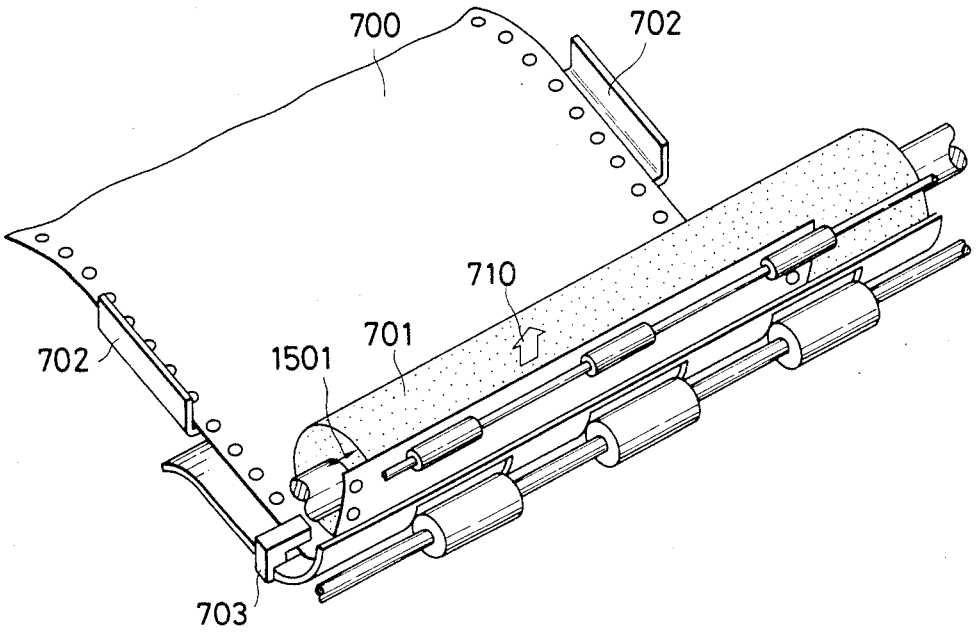
FIG. 13 is a perspective view showing a method of detecting feed holes.
Figure 14:
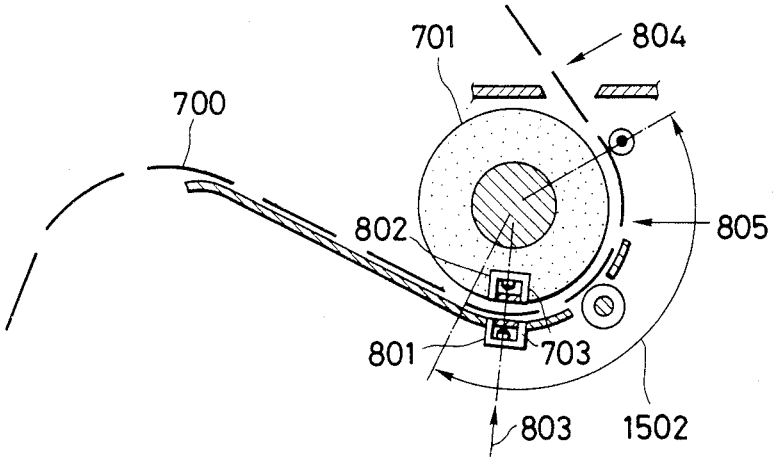
FIG. 14 is a sectional view corresponding to FIG. 13.

FIGS. 13 and 14 illustrate a method in which the part 1501 of one edge of the paper sheet 700 where the feed holes are provided protrudes out of the platen 701, and the protrusive part is passed through the transmission type optical sensor 703, thereby to detect the feed holes. FIG. 14 shows a section taken along the center line of the feed holes.

In this manner, the feed hole start position detecting point 803 can be brought into a region 1502 within which the paper sheet 700 is held in close contact with the platen 701, so that detection error attributed to the rising of the paper sheet can be eliminated. Numerals 702 indicate the paper sheet guides, and arrow 710 indicates the direction of paper feeding.

Although the transmission type optical sensor has been referred to in the examples thus far explained, it may well be replaced with a reflection type optical sensor. Such an example is shown in FIG. 15.

Figure 15:
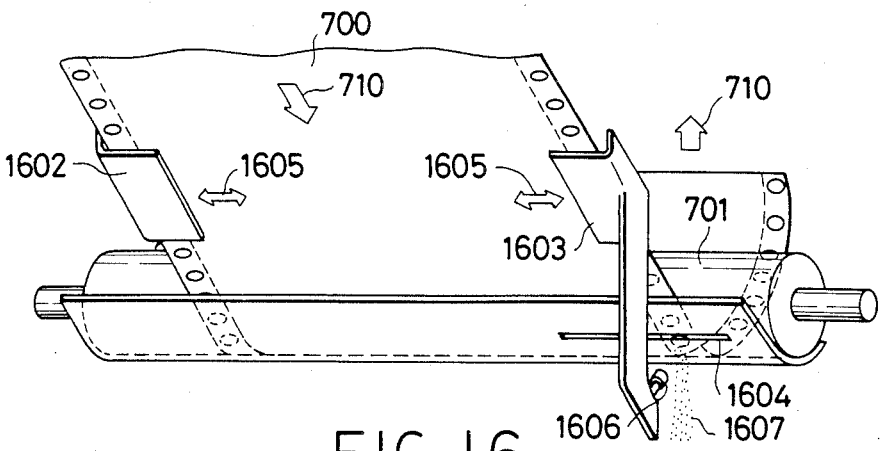
FIG. 15 is a perspective view showing another method of detecting feed holes.

Numerals 1602 and 1603 in FIG. 15 designate paper sheet guides which can be slid rightwards and leftwards (in the directions of arrows 1605), and whose positions are set in conformity with the width of the sheet of paper 700, thereby to prevent the paper sheet from inclining or laterally shifting during paper feeding. One 1603 of the paper sheet guides is furnished with a reflection type optical sensor 1606. When the paper sheet guide 1603 has been set to the edge of the paper sheet 700, the sensor 1606 comes just to a position through which feed holes pass. The reflection type optical sensor 1606 is a set consisting of a light emitting diode and a photodiode. Light emergent from the light emitting diode falls on an object and is reflected, and the reflected light enters the photodiode.

Accordingly, a part of different reflection factor can be detected at a precision of about 0.5 mm.

The platen 701 is formed of a low-reflectivity material, such as black rubber, and the feed hole is seen through a slit as shown at numeral 1604, whereby the feed hole can be detected.

Arrow 710 indicates the direction of paper feeding. Numeral 1607 indicates paper dust (dust developing from the paper sheet), and the reflection type optical sensor 1606 is disposed at a position where the paper dust does not fall thereon.

The reflection type optical sensor 1606 has the LED and the PHD within a package. The resolving power of this sensor is about 0.7 mm, and the price thereof is less than $0.50.

Alternatively, a mechanically-operated electric contact (for example, a microswitch) or the like can of course be used as the feed hole detection means.

Figure 16:
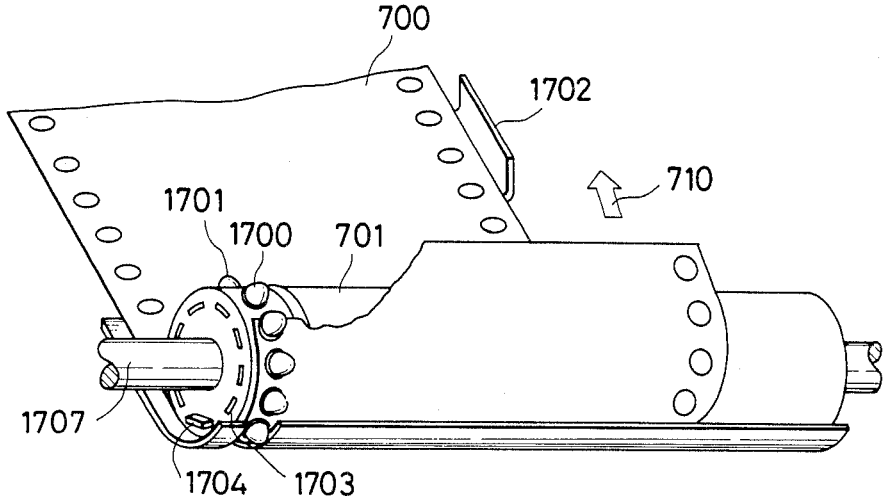
FIG. 16 is a perspective view showing still another method of detecting feed holes.

FIG. 16 shows an example employing a pin wheel 1701 which has protuberances 1700 on a circumferential surface, the protuberances 1700 being held in mesh with the feed holes, whereby advancement of the paper sheet 700 causes the pinwheel to rotate.

Figure 17:
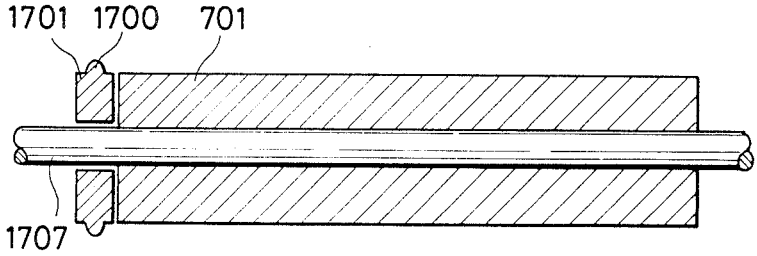
FIG. 17 is a sectional view corresponding to FIG. 16.
Figure 20:
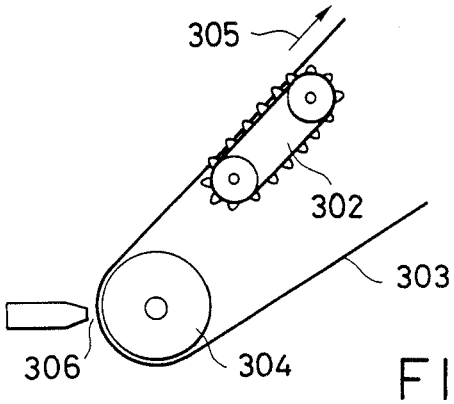
FIG.20 PRIOR ART
FIGS. 20, 21, 22 and 23 are diagrams each showing a typical tractor in a prior art.
Figure 21:
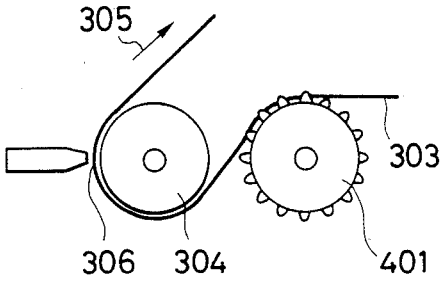
FIG.21 PRIOR ART
Figure 22:
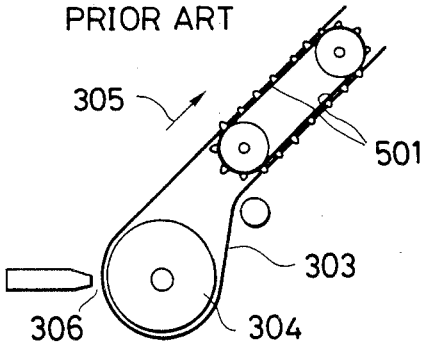
FIG.22 PRIOR ART
Figure 23:
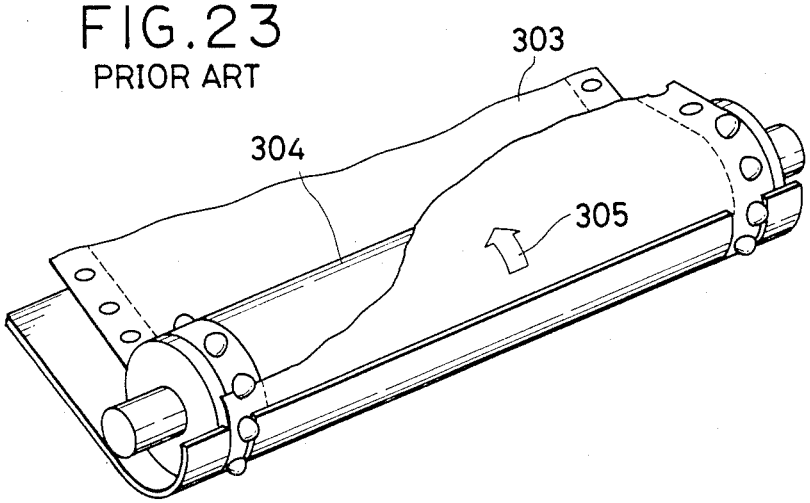
FIG.23 PRIOR ART

This pin wheel 1701 is coaxial with the platen 701, but it is not fixed to the shaft 1707 of the platen 701 as seen from FIG. 17. Therefore, the pin wheel 1701 can rotate freely irrespective of the rotation of the platen 701. Since the protuberances 1700 of the pin wheel 1701 are held in mesh with the feed holes, the wheel 1701 is rotated according to the movement of the paper sheet 700 during paper feeding. The amount of paper fed can be detected by sensing the rotation of the pin wheel 1701 with any sensor. In the illustrated example, magnetic substance pieces 1703 corresponding to the protuberances 1700 on the circumference are stuck on the outer side of the pin wheel 1701 and are detected by a magnetic sensor 1704, thereby to detect the feed holes. In FIGS. 16, numeral 1702 indicates a paper sheet guide, and arrow 710 the direction of paper feeding.

The invention has thus been shown and described with reference to specific embodiments. However, it should be noted that the invention is in no way limited to the details of the illustrated method and apparatus changes and modifications may be made without departing from the scope of the appended claims.

I claim:

1. A paper feeding apparatus comprising paper feeding means for feeding a sheet of paper owing to friction thereof with the paper sheet, feed hole detection means for detection, at a feed hole detection position, feed holes formed in at least either edge of the paper sheet and aligned in a direction of the feeding, and a feed-control circuit for measuring an initial phase difference between a feed hole position of the sheet of paper and the feed hole detecting position under an initial state of the paper feeding, counting a number of the feed holes passing through the feed hole detecting position during paper feeding, and feeding the paper by a further length corresponding to the initial phase difference after the counted number of the feed holes has corresponded to one page of the paper sheet, so as to precisely effect the paper feeding of the length for one page of the paper sheet and to precisely control the actual amount of paper feeding, whereby the paper feeding free from an accumulated error is performed without employing a mechanism which positively drives the feed holes.

2. A paper feeding apparatus according to claim 1, wherein said paper feeding means includes a pulse motor as a paper feeding drive source.

3. A paper feeding apparatus according to claim 1, wherein said feed hole detection means is a transmission type optical sensor which includes a light emitting diode and a photodiode.

4. A paper feeding apparatus according to claim 1, wherein the actual amount of paper feeding which is found by said feed hole detection means is expressed in terms of numbers of pulses.

5. A method of employing a frictional sheet-feed mechanism to feed a sheet of paper and of printing lines of print on the sheet of paper at successive line positions on the sheet of paper separated by a nominal inter-line distance, the paper having feed holes formed at least adjacent either edge of the paper sheet and separated by nominal inter-hole distances, comprising the steps of:

A. printing successive print lines on the sheet and advancing the sheet-feed mechanism between print lines;

B. detecting successive feed holes in the paper and determining the distances, referred to herein as the measured inter-hole distances, by which the sheet-feed mechanism advances between detected feed holes;

C. determining for each print line the difference, referred to herein as the advancement discrepancy, between a hole-position deviation and a cumulative line-position adjustment, wherein the hole-position deviation is the cumulative difference between the nominal inter-hole distances and the measured inter-hole distances between the previous successive feed holes on the sheet and wherein the line-position adjustment for a given print line is the difference between the nominal inter-line distance and the advancement distance by which the sheet-feed mechanism advanced since the previous print line;

D. if the advancement discrepancy does not exceed a predetermined maximum, setting the advancement distance by which the sheet-feed mechanism advances between subsequent successive print lines equal to the nominal inter-line distance; and E. if the advancement discrepancy does exceed the predetermined maximum, adjusting the advancement distance between at least a pair of subsequent successive print lines to reduce the advancement discrepancy.

6. For printing on a sheet of paper having feed holes formed at least adjacent either edge of the sheet of paper and separated by nominal inter-hole distances and for advancing the sheet of paper between print lines to be separated by nominal inter-line distances, an apparatus comprising:

A. a sheet-feed mechanism operable by application of control signals thereto to advance the paper sheet;

B. means for printing successive print lines on the sheet;

C. detection means for detecting successive feed holes in the paper and determining the distances, referred to herein as the measured inter-hole distances, by which the sheet-feed mechanism advances between detected feed holes; and D. control means, responsive to the detection means, for:

i. determining for each print line the difference, referred to herein as the advancement discrepancy, between a hole-position deviation and a cumulative line-position adjustment, wherein the hole-position deviation is the cumulative difference between the nominal inter-hole distances and the measured inter-hole distances between the previous successive feed holes on the sheet and wherein the line-position adjustment for a given print line is the difference between the nominal inter-line distance and the advancement distance by which the sheet-feed mechanism advanced since the previous print line; and ii. applying to the sheet-feed mechanism control signals to operate it to advance it between print lines by an advancement distance that (a) is equal to the nominal inter-line distance if the advancement discrepancy does not exceed a predetermined maximum and (b) is adjusted to reduce the advancement discrepancy if the advancement discrepancy does exceed the predetermined maximum.

* * * * *